US012168186B1

(12) United States Patent
Hwang et al.

(10) Patent No.: US 12,168,186 B1
(45) Date of Patent: Dec. 17, 2024

(54) TOY VEHICLE PLAYSET WITH LIQUID CHANNELS

(71) Applicant: Mattel, Inc., El Segundo, CA (US)

(72) Inventors: Jung Jun Hwang, Inglewood, CA (US); Kar Fai So, Kwai Tsing (HK)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 18/392,824

(22) Filed: Dec. 21, 2023

(51) Int. Cl.
*A63H 18/02* (2006.01)

(52) U.S. Cl.
CPC ..... *A63H 18/02* (2013.01)

(58) Field of Classification Search
CPC ..... A63H 18/00; A63H 18/02; A63H 18/021; A63H 18/028; A63H 18/04; A63H 18/06
USPC ..... 446/168, 170, 173, 435, 475, 478, 487
See application file for complete search history.

(56) References Cited

U.S. PATENT DOCUMENTS 3,577,675 A * 5/1971 Kohner ..... A63H 23/10 446/199
3,593,454 A 7/1971 Einfalt
3,665,638 A * 5/1972 Weistrop ..... A63H 23/10 446/166
4,142,724 A 3/1979 Reick
4,227,337 A 10/1980 Murray et al.
4,348,028 A * 9/1982 Barlow ..... A63F 7/3622 273/287
4,349,983 A * 9/1982 Kilroy ..... A63H 18/02 446/76
4,356,657 A 11/1982 Goldfarb et al.
4,515,360 A * 5/1985 Mariol ..... A63H 33/32 217/62
4,961,716 A * 10/1990 Hippely ..... A63H 33/3044 414/917
5,078,642 A * 1/1992 Glessner ..... A63H 18/02 4/546
5,215,491 A * 6/1993 Willet ..... A63H 33/30 446/268
5,586,923 A * 12/1996 Hippely ..... A63H 33/22 446/14
5,643,040 A * 7/1997 Hippely ..... A63H 18/00 446/423
5,836,840 A 11/1998 Bustamante et al.
(Continued)

FOREIGN PATENT DOCUMENTS

CA 2179143 A1 12/1996
CA 2464135 C 3/2011
(Continued)

*Primary Examiner* — Joseph B Baldori
(74) *Attorney, Agent, or Firm* — Edell, Shapiro & Finnan, LLC

(57) ABSTRACT

A toy playset is presented herein. The toy playset includes a first base portion having a first channel and an outlet, as well as a second base portion having a second channel. The first channel is configured to receive a liquid and direct the liquid to the outlet, and the outlet is configured to direct the liquid off the toy playset. The first base portion and the second base portion are configured to move relative to one another to transition the toy playset between a first configuration and a second configuration, and the first channel and the second channel are fluidly coupled to one another in the second configuration such that the second channel is configured to direct liquid toward the outlet via the first channel.

18 Claims, 17 Drawing Sheets

(56) References Cited

U.S. PATENT DOCUMENTS 5,857,891 A * 1/1999 Dahlgren ..... A63H 23/00 446/163
5,871,385 A * 2/1999 Hippely ..... A63H 18/026 446/424
5,971,764 A * 10/1999 Todd ..... G09B 25/08 434/126
6,607,418 B2 * 8/2003 Henry ..... A63H 33/32 446/166
6,616,539 B1 * 9/2003 Gatto ..... A63H 33/32 472/126
6,663,464 B2 * 12/2003 Payne ..... A63H 33/28 446/16
7,618,301 B2 * 11/2009 Knight ..... A63H 33/42 446/478
8,182,308 B2 * 5/2012 Payne ..... A63H 23/10 446/268
8,251,768 B2 * 8/2012 Nuttall ..... A63H 23/16 446/166
8,267,738 B2 * 9/2012 Nuttall ..... A63H 18/06 446/153
8,317,565 B2 11/2012 Shallah
8,500,510 B2 * 8/2013 Nuttall ..... A63H 23/005 446/166
8,628,373 B2 * 1/2014 Payne ..... A63H 18/00 446/14
8,734,200 B2 5/2014 Payne et al.
8,814,628 B2 * 8/2014 O'Connor ..... A63H 18/02 446/435
11,426,672 B1 * 8/2022 Hwang ..... A63H 33/003
11,541,302 B2 1/2023 Kreuzer et al.
2005/0176338 A1 * 8/2005 Delaney ..... A63H 23/00 446/92
2011/0117813 A1 * 5/2011 O'Connor ..... A63H 17/44 446/423
2012/0267392 A1 10/2012 Wright
2013/0052906 A1 2/2013 Payne
2013/0324003 A1 * 12/2013 Hippely ..... A63H 23/10 446/153

FOREIGN PATENT DOCUMENTS

CA 2610469 C 11/2011
CA 2602601 C 4/2015
CN 102596344 A 7/2012
CN 110801637 A 2/2020
EP 192755 A1 9/1986

* cited by examiner

TOY VEHICLE PLAYSET WITH LIQUID CHANNELS

TECHNICAL FIELD

The present application relates generally to toys and, in particular, to a toy vehicle playset with channels to direct liquid off the toy vehicle playset.

BACKGROUND

Toys provide entertainment for different users, such as children. For example, a toy may include various features with which a child may play. An example toy that may entertain a child is a toy vehicle, which may emulate the appearance, movement, and/or feel of a real-world vehicle. New toys with new features, such as liquid play features that allow a toy vehicle to interact with liquid, can provide added play value and provide additional entertainment. However, the liquid play feature may cause the liquid to flow and distribute in a manner that may be difficult to clean or remove.

SUMMARY

A toy playset is presented herein. According to one example embodiment, the toy playset includes a first base portion having a first channel and an outlet, as well as a second base portion having a second channel. The first channel is configured to receive a liquid and direct the liquid to the outlet, and the outlet is configured to direct the liquid off the toy playset. The first base portion and the second base portion are configured to move relative to one another to transition the toy playset between a first configuration and a second configuration, and the first channel and the second channel are fluidly coupled to one another in the second configuration such that the second channel is configured to direct liquid toward the outlet via the first channel.

Other systems, methods, features, and advantages will be, or will become, apparent to one with skill in the art upon examination of the following figures and detailed description. All such additional systems, methods, features, and advantages are included within this description and are within the scope of the claimed subject matter.

BRIEF DESCRIPTION OF THE DRAWINGS

The toy playset presented herein may be better understood with reference to the following drawings and description. Unless dimensions of elements of the drawings are specifically called-out and described herein, it should be understood that the elements in the figures are not necessarily to scale and that emphasis has been placed upon illustrating the principles of the toy playset. In the figures, like-referenced numerals designate corresponding parts throughout the different views.

DETAILED DESCRIPTION

Overall, a toy vehicle playset is presented herein. The toy vehicle playset includes a track configured to receive a toy vehicle and direct movement of the toy vehicle through at least a portion of the playset. The toy playset also includes a liquid play feature that can interact with the toy vehicle. For example, the liquid play feature may include a container configured to hold a liquid, and the toy vehicle may be positioned within the container to contact (e.g., be submersed in) the liquid. Moreover, the toy playset includes a channel configured to direct liquid off the toy playset. For instance, liquid may spill from the container and/or be carried by the toy vehicle onto another part of the toy playset, and in these instances, the channel receives the spilled/carried liquid and directs the liquid in a controlled manner (e.g., in a single direction off the toy playset), such as toward an outlet. Thus, the channel allows the liquid to be easily and efficiently cleaned (e.g., removed) from the toy playset, such as by preventing or at least discouraging unwanted and uncontrolled flow of the liquid (e.g., in multiple directions off the toy playset).

Figure 1A:
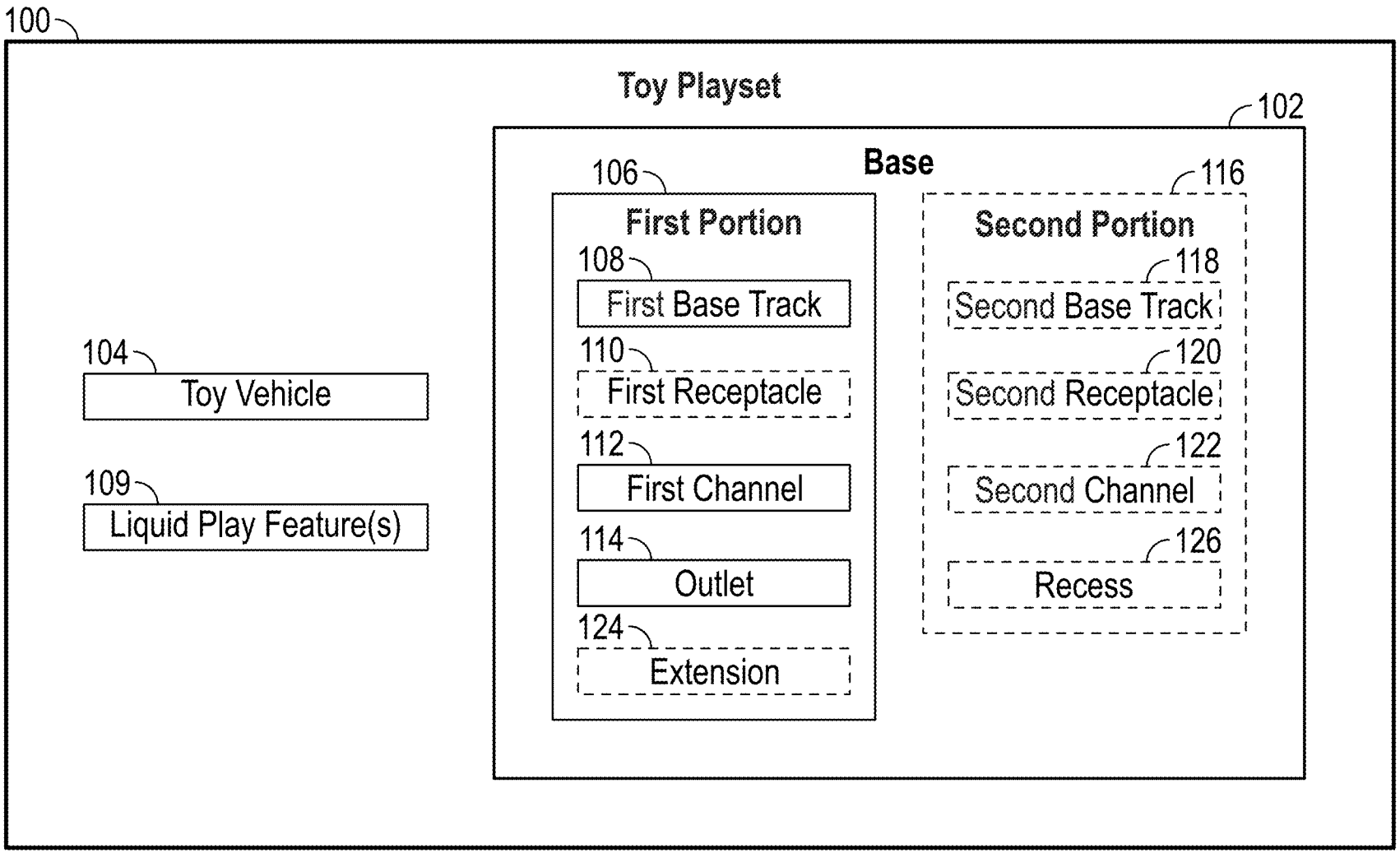
FIG. 1A illustrates a schematic diagram of a toy playset, in accordance with example embodiments of the present application.

FIG. 1A illustrates a schematic diagram of an embodiment of a toy playset 100, such as a toy vehicle playset. The toy playset 100 includes a base 102 configured to receive a toy vehicle 104 of the toy playset 100. For instance, the base 102 may include a first portion 106 with a first base track 108 configured to receive the toy vehicle 104. The first base track 108 is configured to direct movement of the toy vehicle 104. By way of example, the first base track 108 may include turns and/or loops that facilitate movement of the toy vehicle 104 along the base 102, thereby providing an interactive play feature.

The toy playset 100 also includes one or more liquid play features 109 that may interact with the toy vehicle 104. For example, each liquid play feature 109 may include a container in which liquid is stored. In such instances, the container may be configured to receive the toy vehicle 104, thereby placing the toy vehicle 104 in contact with (e.g., by at least partially submersing the toy vehicle 104 within) the liquid. As an example, exposure of the toy vehicle 104 with the liquid via the liquid play feature 109 may provide a car wash simulation and/or a path obstacle to enhance the entertainment provided by the toy playset 100. As other examples, the liquid play feature could be or include sprayers, sprinklers, fountains, showers, or any other type of feature capable of introducing liquid to the toy playset 100.

In some embodiments, the liquid play feature(s) 109 is configured to be coupled to the base 102. For example, the base 102 may include a first receptacle 110 in which a liquid play feature 109 (e.g., the container) may be positioned. Positioning of the liquid play feature 109 in the first receptacle 110 may, for example, position the liquid play feature 109 adjacent to the first base track 108. Thus, the liquid play feature 109 may be within the path of travel of the toy vehicle 104 along the first base track 108. Consequently, traversal of the toy vehicle 104 along the first base track 108 may cause the toy vehicle 104 to interact with the liquid play feature 109. However, in other embodiments, the base 102 need not include a receptacle 110 and may support a liquid play feature 109 in any desirable manner.

Interaction between the toy vehicle 104 and the liquid play feature 109 may cause liquid to spill from the liquid play feature 109 (e.g., from the container) onto the base 102, such as onto the first base track 108. The base 102 therefore includes a first channel 112 configured to direct the liquid in a controlled manner along the base 102. By way of example, the first channel 112 may receive the liquid spilled from the liquid play feature 109 and direct the liquid toward an outlet 114 configured to discharge the liquid off the base 102 and out of the toy playset 100. Thus, the first channel 112 may control liquid flow along the base 102, such as in a predictable manner toward the outlet 114, to prevent or at least discourage flow of liquid off the toy playset 100 in various, uncontrolled/unpredictable directions and/or locations. For this reason, the first channel 112 and the outlet 114 may enable the liquid to be cleaned more easily/efficiently from the toy playset 100 (e.g., by collecting liquid at a single drainage point adjacent to the outlet 114).

In certain embodiments, the first channel 112 is formed into the first base track 108. Thus, liquid spilled onto the first base track 108 (e.g., liquid carried by the toy vehicle 104 onto the first base track 108) may be directed into the first channel 112 and subsequently directed toward the outlet 114. In additional or alternative embodiments, the first receptacle 110 is fluidly coupled to the first channel 112. Thus, the liquid may flow through the first receptacle 110 and/or the first channel 112 toward the outlet 114.

The base 102 may also include multiple portions configured to move relative to one another in some embodiments. For example, the base 102 may include a second portion 116 configured to move (e.g., rotate) relative to the first portion 106. The second portion 116 may include a second base track 118 configured to receive the toy vehicle 104 and direct movement of the toy vehicle 104 along the second portion 116. The second portion 116 may also include a second receptacle 120 in which an additional liquid play feature 109 may be positioned to couple to the base 102. The second portion 116 may further include a second channel 122 configured to direct liquid in a controlled manner along the base 102. For instance, the second channel 122 may be formed into the second base track 118 and/or may be fluidly coupled to the second receptacle 120.

In some embodiments, the first portion 106 and the second portion 116 are movable relative to one another to transition the toy playset 100 between a first configuration and a second configuration. In the first configuration, which may be a play configuration, the first base track 108 and the second base track 118 are engaged with one another such that the toy vehicle 104 may readily move between the first base track 108 and the second base track 118. As such, the first configuration of the toy playset 100 may enable the toy vehicle 104 to move along the base 102 to provide a more interactive experience. In the second configuration, which may be a storage/transport configuration, the second channel 122 and the outlet 114 may be fluidly coupled to one another. By way of example, the second channel 122 may direct liquid toward the outlet 114 via the first channel 112. Consequently, the second configuration may enable the liquid to be readily directed to the outlet 114 from each of the first portion 106 and the second portion 116. In other words, the first channel 112 and the second channel 122 may direct liquid to a common location at the outlet 114. Therefore, liquid spilled onto the base 102 (e.g., onto different parts of the base 102, including the first portion 106 and the second portion 116) from the liquid play feature(s) 109 may be more easily cleaned or collected (e.g., at the outlet 114) from the toy playset 100 in the second configuration. In certain embodiments, the first base track 108 and the second base track 118 are disengaged with one another in the second configuration, and/or the outlet 114 and the second channel 122 are fluidly separate from one another in the first configuration.

To secure the toy playset 100 within the second configuration, the first portion 106 may include an extension 124 and the second portion 116 may include a recess 126. In the second configuration, the first portion 106 and the second portion 116 are oriented to insert the extension 124 into the recess 126 such that the second portion 116 captures the extension 124 within the recess 126 to block relative movement between the first portion 106 and the second portion 116. Accordingly, insertion of the extension 124 within the recess 126 maintains the toy playset 100 in the second configuration. As a result, liquid may be more controllably directed along the base 102 (e.g., to avoid unwanted spillage of liquid from the second channel 122 otherwise caused by unwanted movement of the second portion 116 relative to the first portion 106 to fluidly decouple the second channel 122 from the outlet 114). In additional or alternative embodiments, the second portion 116 may include an extension and the first portion 106 may include a recess configured to block relative movement between the first portion 106 and the second portion 116. In further embodiments, the first portion 106 and the second portion 116 may include any other suitable features to secure the toy playset 100 in the second configuration.

It should be noted that the base 102 may include any quantity of movable portions in alternative embodiments. As an example, the base 102 may include a single portion. Indeed, the second portion 116 may be optional, and the base 102 may include the first portion 106 and not the second portion 116. As another example, the base 102 may include more than two portions that are movable relative to one another, such as to arrange the portions in a manner to enable liquid to be directed along each portion toward a common location (e.g., the outlet 114 of the first portion 106).

Figure 1B:
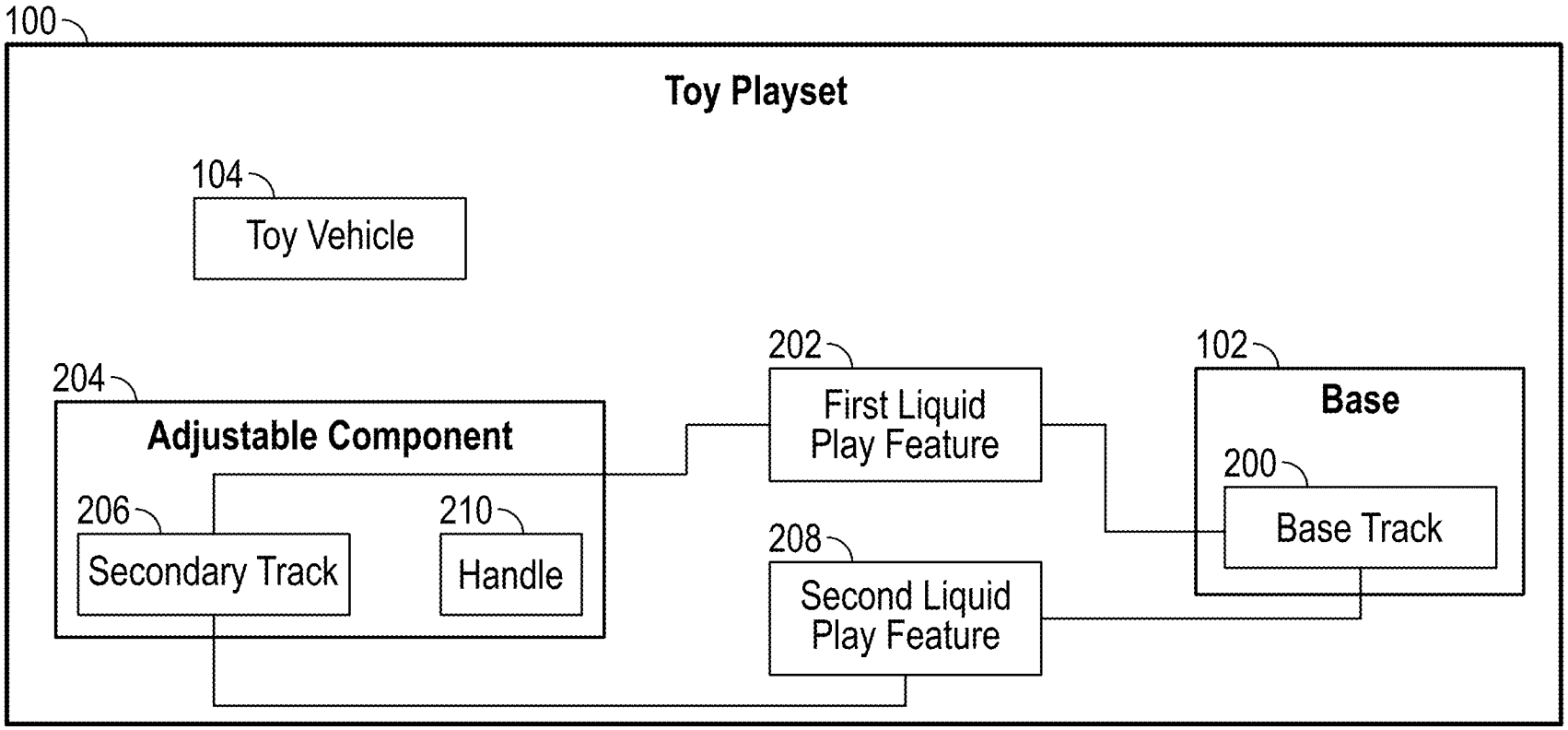
FIG. 1B illustrates a schematic diagram of a toy playset, in accordance with example embodiments of the present application.

FIG. 1B is a schematic diagram of the toy playset 100 illustrating a possible path of travel for the toy vehicle 104 (e.g., in the first configuration of the toy playset 100). For example, a base track 200 (e.g., the first base track 108 of FIG. 1A) of the base 102 may be connected to a first liquid play feature 202 (e.g., one of the liquid play features 109 of FIG. 1A) to enable the toy vehicle 104 to move from the base track 200 to the first liquid play feature 202. The toy playset 100 schematically illustrated in FIG. 1B also includes an adjustable component 204 with a secondary track 206 connected to the first liquid play feature 202. Thus, the toy vehicle 104 may move from the first liquid play feature 202 to the secondary track 206. The secondary track 206 is connected to a second liquid play feature 208 (e.g., another of the liquid play features 109 of FIG. 1A) to enable the toy vehicle 104 to move from the secondary track 206 to the second liquid play feature 208. The second liquid play feature 208 is connected to the base track 200 (e.g., the second base track 118 of FIG. 1A) to enable the toy vehicle 104 to move from the second liquid play feature 208 back to the base track 200.

The adjustable component 204 is coupled to the base 102 and is configured to move relative to the base 102. For instance, the adjustable component 204 may be moved manually. As such, the adjustable component 204 includes a handle 210 that is able to be grasped by the user to help the user provide a sufficient amount of force that causes the adjustable component 204 to move relative to the base 102. As an example, movement of the adjustable component 204 relative to the base 102 may orient the secondary track 206 in different manners to enable receipt of the toy vehicle 104 from the first liquid play feature 202 and/or to direct the toy vehicle 104 to the second liquid play feature 208. As another example, movement of the adjustable component 204 may orient the adjustable component 204 to direct liquid off the adjustable component 204, such as toward the outlet 114 (FIG. 1A). Additionally or alternatively, the handle 210 may be used to carry the toy playset 100. For instance, the adjustable component 204 and/or the base 102 may include a feature that blocks relative movement of the adjustable component 204 relative to the base 102 to enable the handle 210 to be used to lift the adjustable component 204 and the base 102 together. As such, the handle 210 may be used to transport or carry the toy playset 100.

Figure 2:
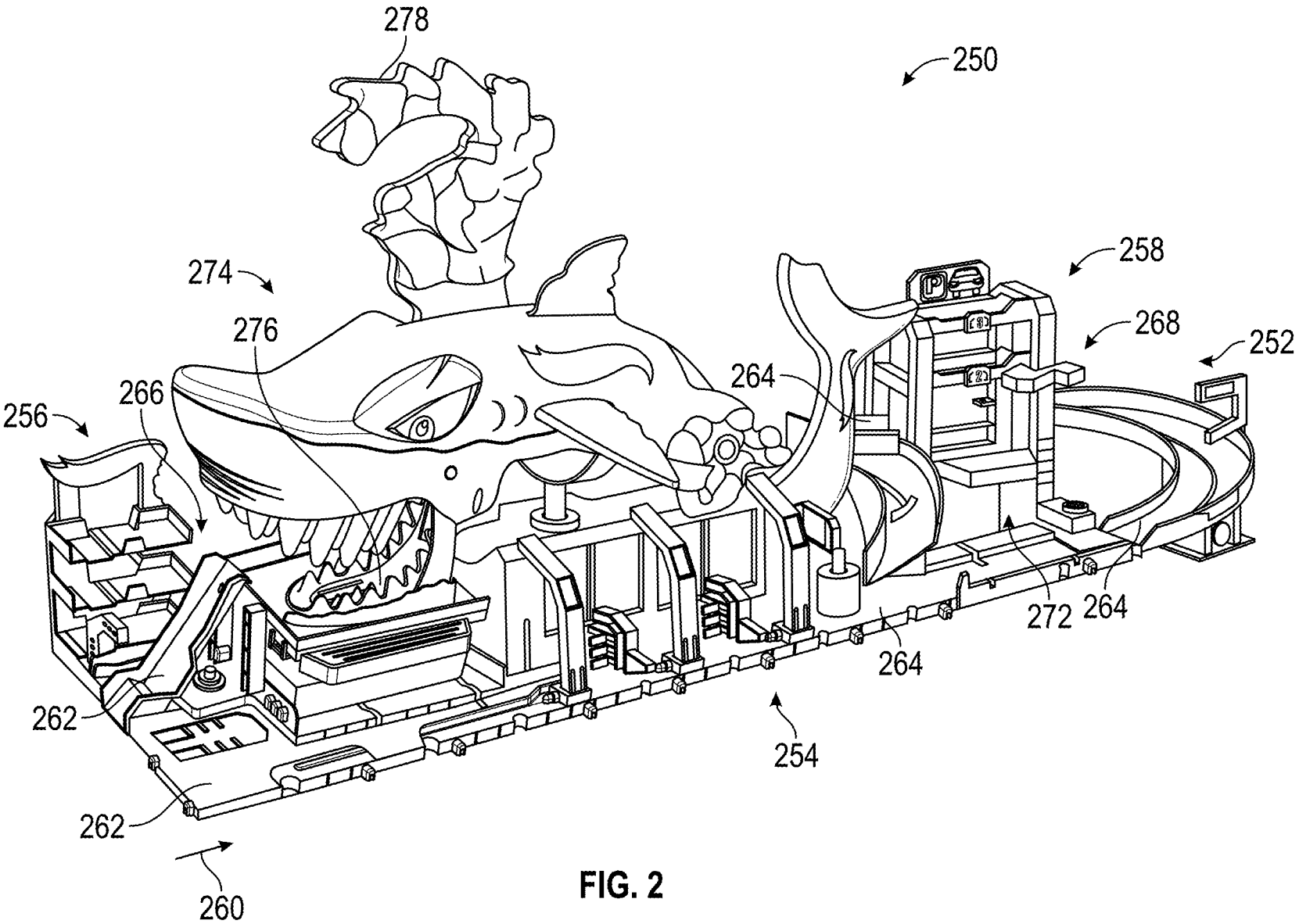
FIG. 2 illustrates a perspective side view of a toy playset in a first configuration, in accordance with example embodiments of the present application.

FIG. 2 is a perspective side view of a toy playset 250 in a first configuration 252 (e.g., a play configuration, an extended configuration). The toy playset 250 includes a base 254 with a first portion 256 and a second portion 258 that are movable relative to one another. In the first configuration 252, the first portion 256 and the second portion 258 extend from one another generally along a first axis 260 (e.g., a longitudinal axis). The first portion 256 includes a first base track 262, and the second portion 258 includes a second base track 264. The first base track 262 and the second base track 264 are coupled to one another in the first configuration 252.

The toy playset 250 also includes a first liquid play feature 266 that is couplable to the first portion 256, as well as a second liquid play feature 268 that is couplable to the second portion 258. For instance, the first liquid play feature 266 may be configured to be positioned in a first receptacle 270 of the first portion 256, and the second liquid play feature 268 may be configured to be positioned in a second receptacle 272 of the second portion 258. Additionally, the toy playset 250 includes an adjustable component 274 coupled to the first portion 256. The adjustable component 274 includes a secondary track 276, and at least part of the secondary track 276 is configured to extend toward a section of the first base track 262 and into the first liquid play feature 266 positioned in the first receptacle 270. The adjustable component 274 also includes a handle 278 for grasping by a user to facilitate movement of the adjustable component 274 relative to the base 254.

Figure 3A:
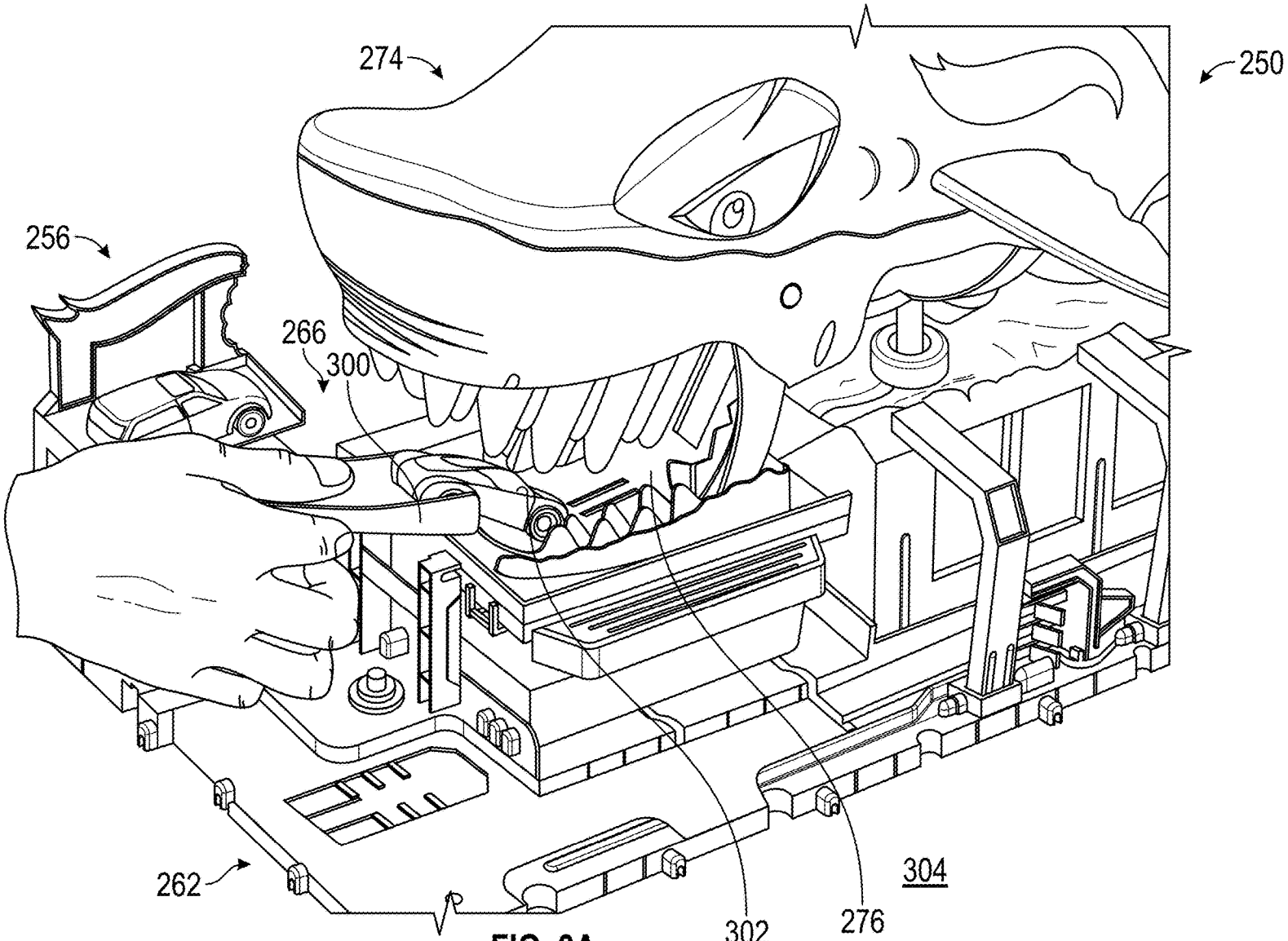
FIG. 3A illustrates a perspective side view of a first portion of the toy playset of FIG. 2.

FIG. 3A is a perspective side view of the first portion 256 of the toy playset 250. In the illustrated embodiment, the adjustable component 274 is positioned to extend the secondary track 276 into the first liquid play feature 266 (e.g., a container) and adjacent to a section 300 of the first base track 262. Thus, a toy vehicle 302 of the toy playset 250 may move from the section 300 to the secondary track 276 and into the first liquid play feature 266. By way of example, the section 300 (e.g., a ramp) is configured to move to slope toward the secondary track 276 (e.g., and extend obliquely relative to a surface 304 on which the toy playset 250 is placed) to enable a gravitational force to drive movement of the toy vehicle 302 from the section 300 to the secondary track 276. Thus, the section 300 facilitates movement of the toy vehicle 302 from the section 300 into the first liquid play feature 266.

Figure 3B:
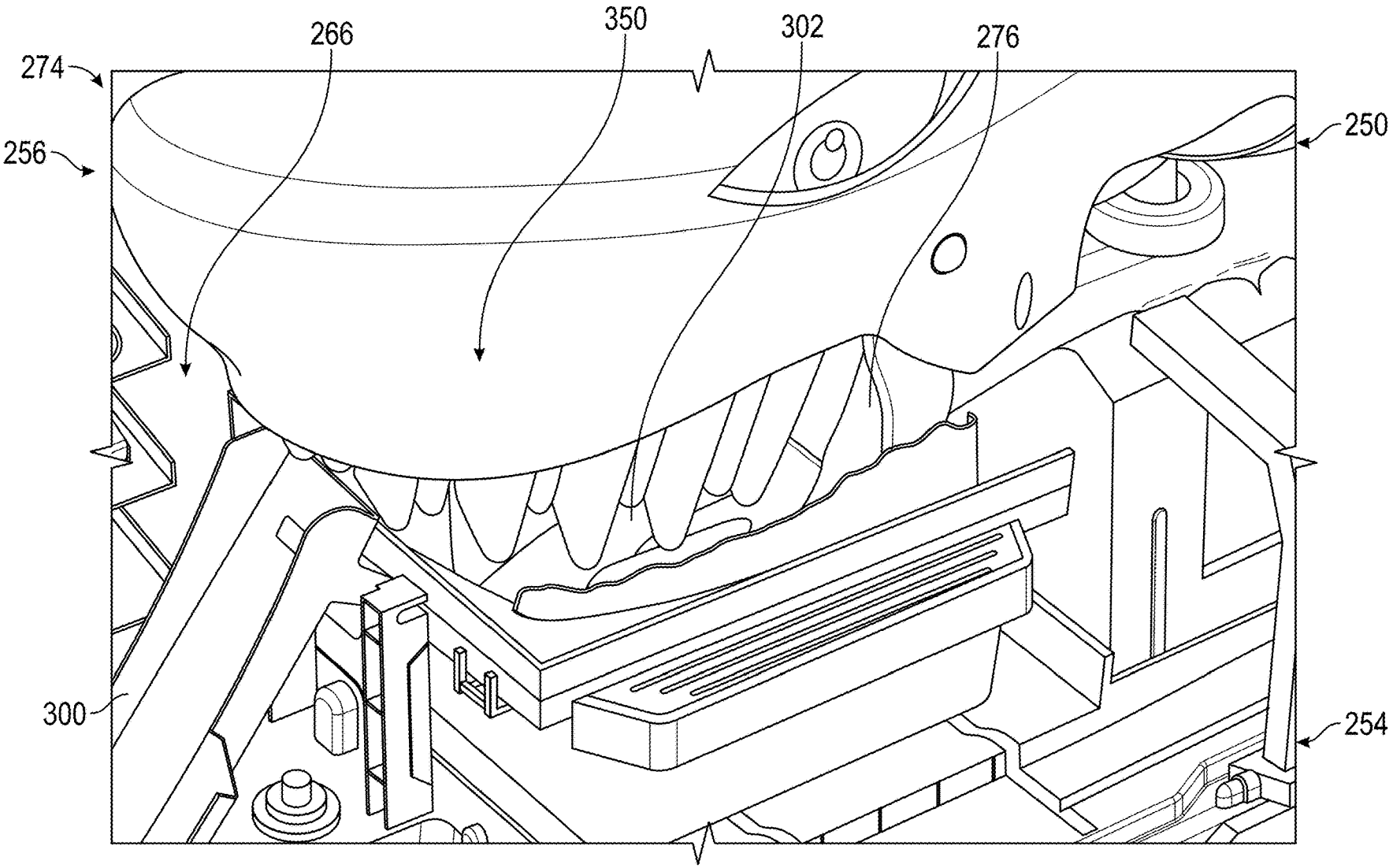
FIG. 3B illustrates a perspective side view of the first portion of the toy playset of FIG. 3A.

FIG. 3B is a perspective side view of the first portion 256 of the toy playset 250. As discussed, the adjustable component 274 is configured to move relative to the base 254. By way of example, the adjustable component 274 is movable to move the secondary track 276, as well as the toy vehicle 302 positioned on the secondary track 276, in a first direction 350 (e.g., a downward direction) further into the first liquid play feature 266. For example, the first liquid play feature 266 is configured to hold liquid, and movement of the adjustable component 274 in the first direction 350 at least partially submerges the toy vehicle 302 within the liquid held in the first liquid play feature 266. Such interaction between the first liquid play feature 266, the adjustable component 274, and the toy vehicle 302 may increase an interactive experience with the toy playset 250. If the vehicle is thermochromic or includes thermochromic features, submerging the vehicle 302 in the liquid may cause the vehicle or vehicle features to change color and entertain a user. Moreover, submerging a vehicle in the first liquid play feature 266 may cause liquid to splash or spill onto the first portion 256. As is detailed below, the techniques presented herein may enable the playset 250 to contain and collect this spillage/splashing.

Figure 3C:
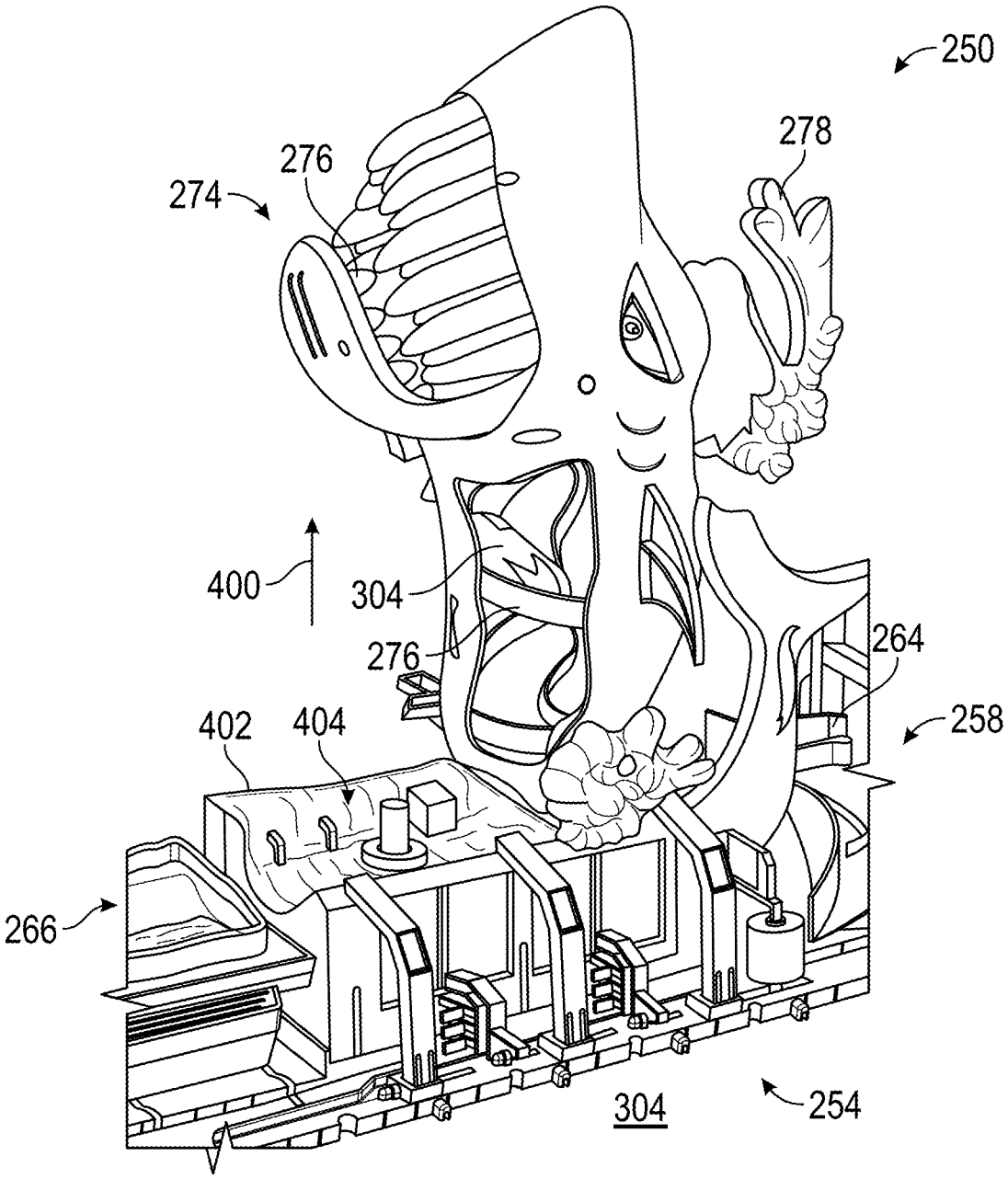
FIG. 3C illustrates a perspective side view of the first portion of the toy playset of FIG. 3A.

FIG. 3C is a perspective side view of the first portion 256 of the toy playset 250. In the illustrated embodiment, the adjustable component 274 extends away from the first liquid play feature 266. For example, a user may grasp the handle 278 of the adjustable component 274 to move the secondary track 276 in a second direction 400 (e.g., an upward direction). Such an orientation of the adjustable component 274 directs the toy vehicle 302 along the secondary track 276. As an example, the secondary track 276 may slope toward the surface 304 (e.g., in a helical or spiral arrangement) to enable a gravitational force to move the toy vehicle 302 along the secondary track 276. Such movement of the toy vehicle 302 may move the toy vehicle 302 toward the second base track 264 of the second portion 258.

Contact between the toy vehicle 302 and the liquid held in the first liquid play feature 266 may cause the toy vehicle 302 to carry some liquid. Thus, movement of the toy vehicle 302 from within the first liquid play feature 266 to the adjustable component 274 may cause the toy vehicle 302 to carry liquid from the first liquid play feature 266 to the adjustable component 274, such as along the secondary track 276. The toy playset 250 includes features to direct such liquid from the adjustable component 274 toward the first liquid play feature 266. By way of example, the adjustable component 274 is coupled to a support 402 of the base 254, and the secondary track 276 of the adjustable component 274 is configured to direct liquid to the support 402 (e.g., via a gravitational force). The support 402 defines a passage 404 (e.g., a channel) configured to receive liquid from the secondary track 276, and the support 402 is oriented (e.g., sloped toward the first liquid play feature 266)

to direct liquid along the passage 404 and into the first liquid play feature 266, such as via a gravitational force. As such, the passage 404 directs liquid in a controlled manner to avoid unwanted flow of liquid along the toy playset 250 (e.g., away from the first liquid play feature 266).

Furthermore, directing liquid into the first liquid play feature 266 via the support 402 may help readily replenish the supply of liquid within the first liquid play feature 266. That is, the toy vehicle 302 may carry liquid out of the first liquid play feature 266 to the adjustable component 274 to initially reduce a supply of liquid within the first liquid play feature 266. However, the support 402 directs liquid from the secondary track 276 back into the first liquid play feature 266 to increase the supply of liquid within the first liquid play feature 266. Thus, the amount of liquid within the first liquid play feature 266 may be substantially maintained or at least reduced more slowly to enable continued play of the toy playset 250 (e.g., without having to manually replenish the supply of liquid within the first liquid play feature 266). However, to be clear, the support 402 need not be the only component to provide such replenishment paths. In other embodiments, replenishment paths might be included in any desirable part, portion, feature, etc. of a playset.

Figure 4A:
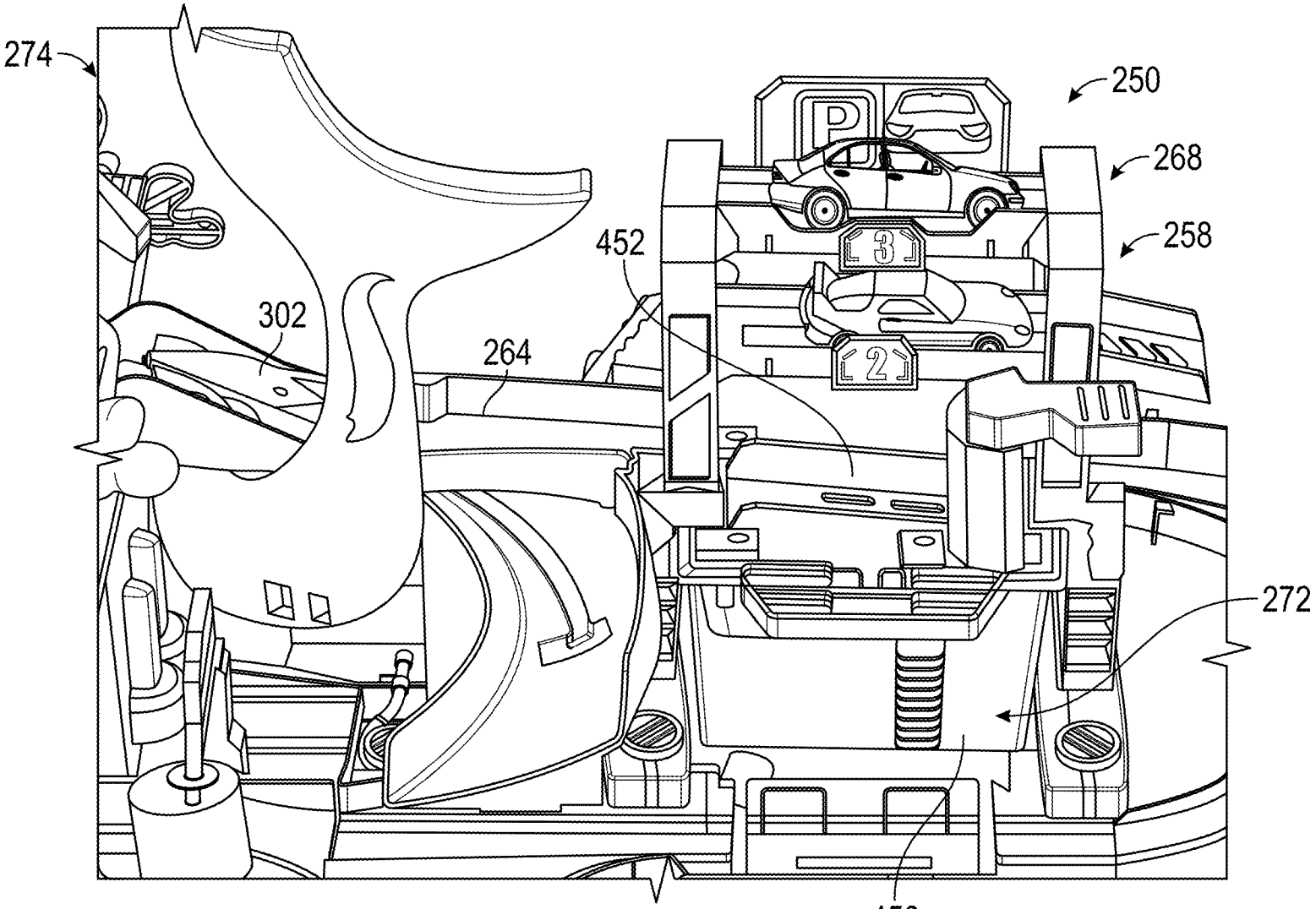
FIG. 4A illustrates a perspective side view of a second portion of the toy playset of FIG. 2.

FIG. 4A is a perspective side view of the second portion 258 of the toy playset 250 (e.g., in the first configuration 252 of FIG. 2). In the illustrated embodiment, the toy vehicle 302 is discharged from the adjustable component 274 (e.g., from the secondary track 276) to the second base track 264 of the second portion 258. The second liquid play feature 268 is coupled to the second portion 258 between different sections of the second base track 264. For instance, the second liquid play feature 268 may include a container 450 configured to be positioned within the second receptacle 272, as well as a liquid play track 452 positioned within the container 450. The second liquid play feature 268 divides the second base track 264 such that the toy vehicle 302 moves along the liquid play track 452 and through the second liquid play feature 268 during movement along the second base track 264.

Figure 4B:
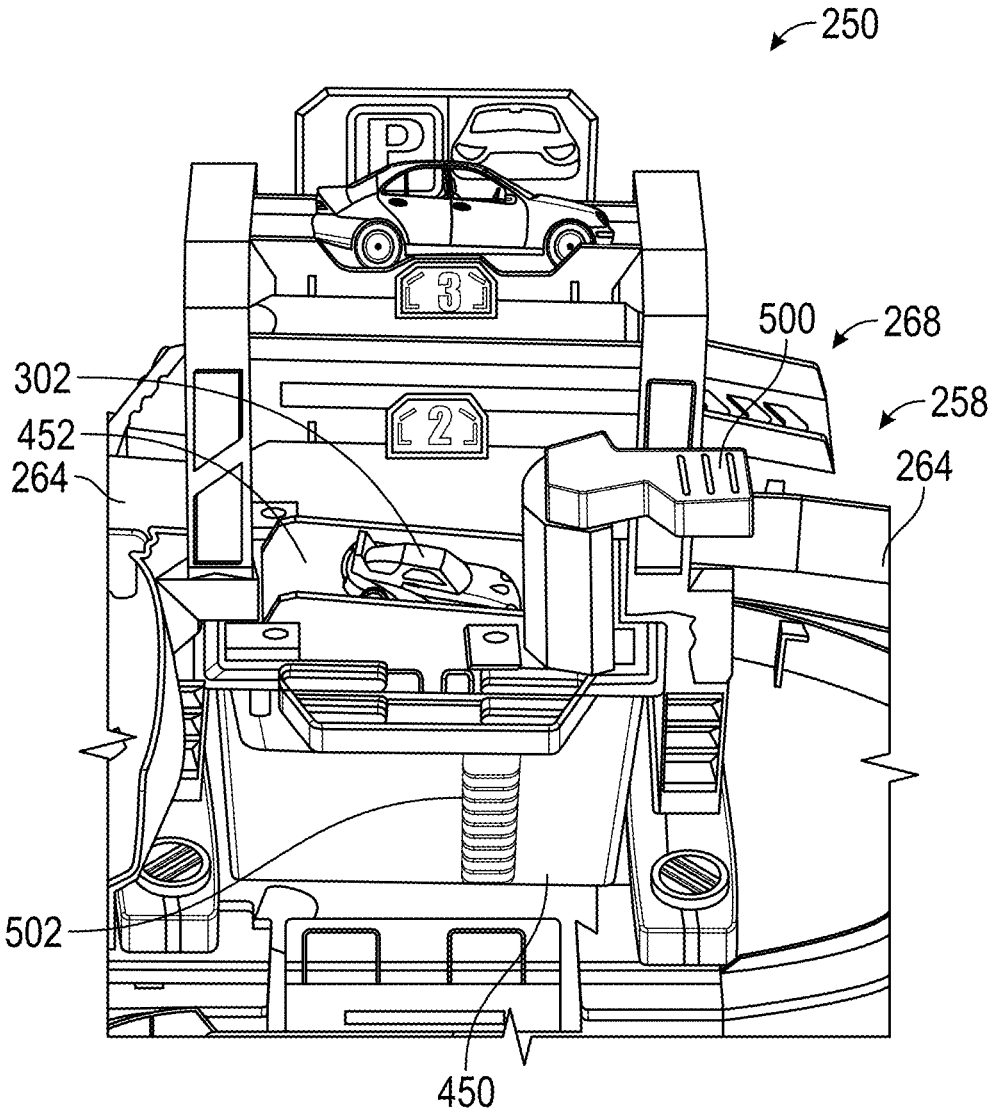
FIG. 4B illustrates a perspective side view of the second portion of the toy playset of FIG. 4A.

FIG. 4B is a perspective side view of the second portion 258 of the toy playset 250 in which the toy vehicle 302 is positioned on the liquid play track 452 of the second liquid play feature 268. The liquid play track 452 is configured to move relative to the container 450. For example, the second liquid play feature 268 may include a lever 500 coupled to the liquid play track 452, and a user may impart a force onto the lever 500 to move the lever 500, and therefore the liquid play track 452, relative to the container 450, such as to move the liquid play track 452 further into the container 450. Additionally, the second liquid play feature 268 may include a biasing member 502 (e.g., a spring) configured to provide a force that urges movement of the liquid play track 452 out of the container 450. With a biasing member 502, the liquid play track 452 will be held in a position above or slightly submerged in the container 450 until a sufficient force is imparted onto the liquid play track 452 (e.g., via the lever 500). As an example, the container 450 may be configured to hold liquid, and the biasing member 502 is configured to maintain a position of the liquid play track 452 relative to the container 450 at a position that avoids contact between the toy vehicle 302 and the liquid within the container 450.

Figure 4C:
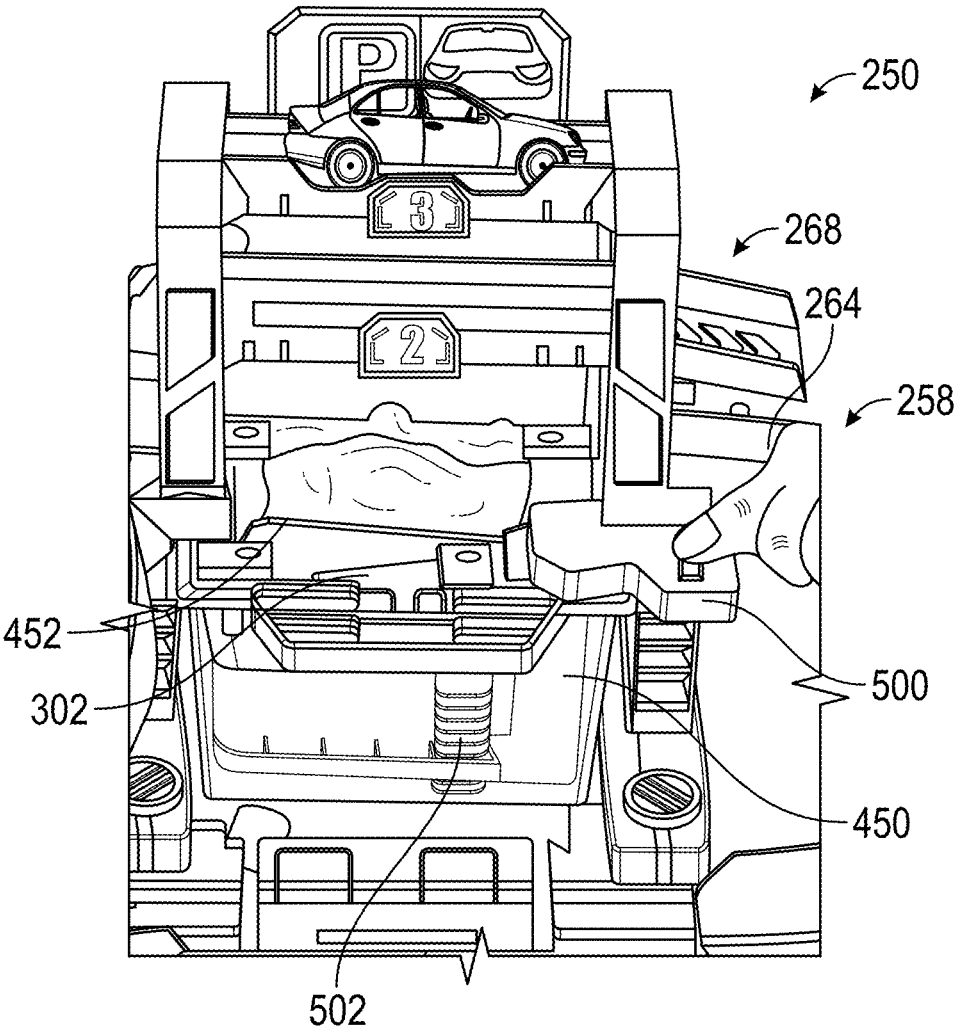
FIG. 4C illustrates a perspective side view of the second portion of the toy playset of FIG. 4A.

FIG. 4C is a perspective side view of the second portion 258 of the toy playset 250. In the illustrated embodiment, the liquid play track 452 is positioned within the container 450 to submerge the toy vehicle 302 in the liquid held in the container 450. For instance, a user imparts a force onto the lever 500 to overcome the force imparted by the biasing member 502 to force the liquid play track 452 farther into the container 450. As a result, the toy vehicle 302 comes into contact with the liquid in the container 450. This may displace liquid from the container 450, causing the liquid to spill or otherwise move onto the second portion 258 of the toy playset 250. This may also cause the toy vehicle 302 to capture and carry liquid.

Figure 4D:
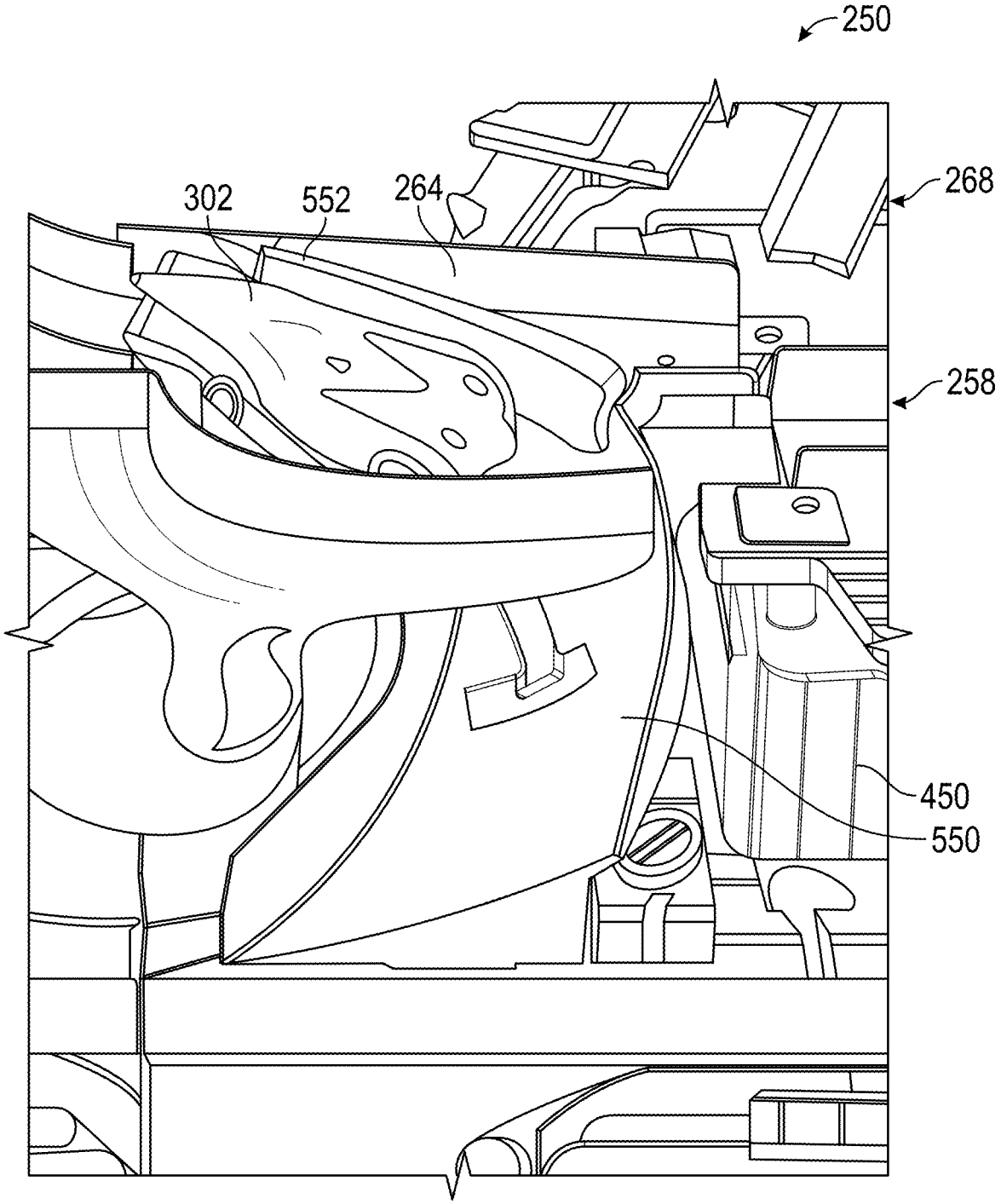
FIG. 4D illustrates a perspective side view of the second portion of the toy playset of FIG. 4A.

FIG. 4D is a perspective side view of the second portion 258 of the toy playset 250 illustrating the toy vehicle 302 moving along a bypass track 550. The bypass track 550 enables the toy vehicle 302 to avoid moving through the second liquid play feature 268. By comparison, movement of the toy vehicle 302 through the second liquid play feature 268 causes the toy vehicle 302 to avoid moving along the bypass track 550. Thus, the toy vehicle 302 moves along either the bypass track 550 or through the second liquid play feature 268. In some embodiments, the second portion 258 includes an adjustable barrier 552 that may be moved to direct the toy vehicle 302 through the second liquid play feature 268 or along the bypass track 550. As an example, in a first position, which is shown in FIG. 4A, the adjustable barrier 552 is configured to block access to the bypass track 550 from the adjustable component 274 to force the toy vehicle 302 to move through the second liquid play feature 268 instead of along the bypass track 550. In a second position, as shown in FIG. 4D, the adjustable barrier 552 is configured to block access to the second liquid play feature 268 from the adjustable component 274 to force the toy vehicle 302 to move along the bypass track 550.

Figure 5:
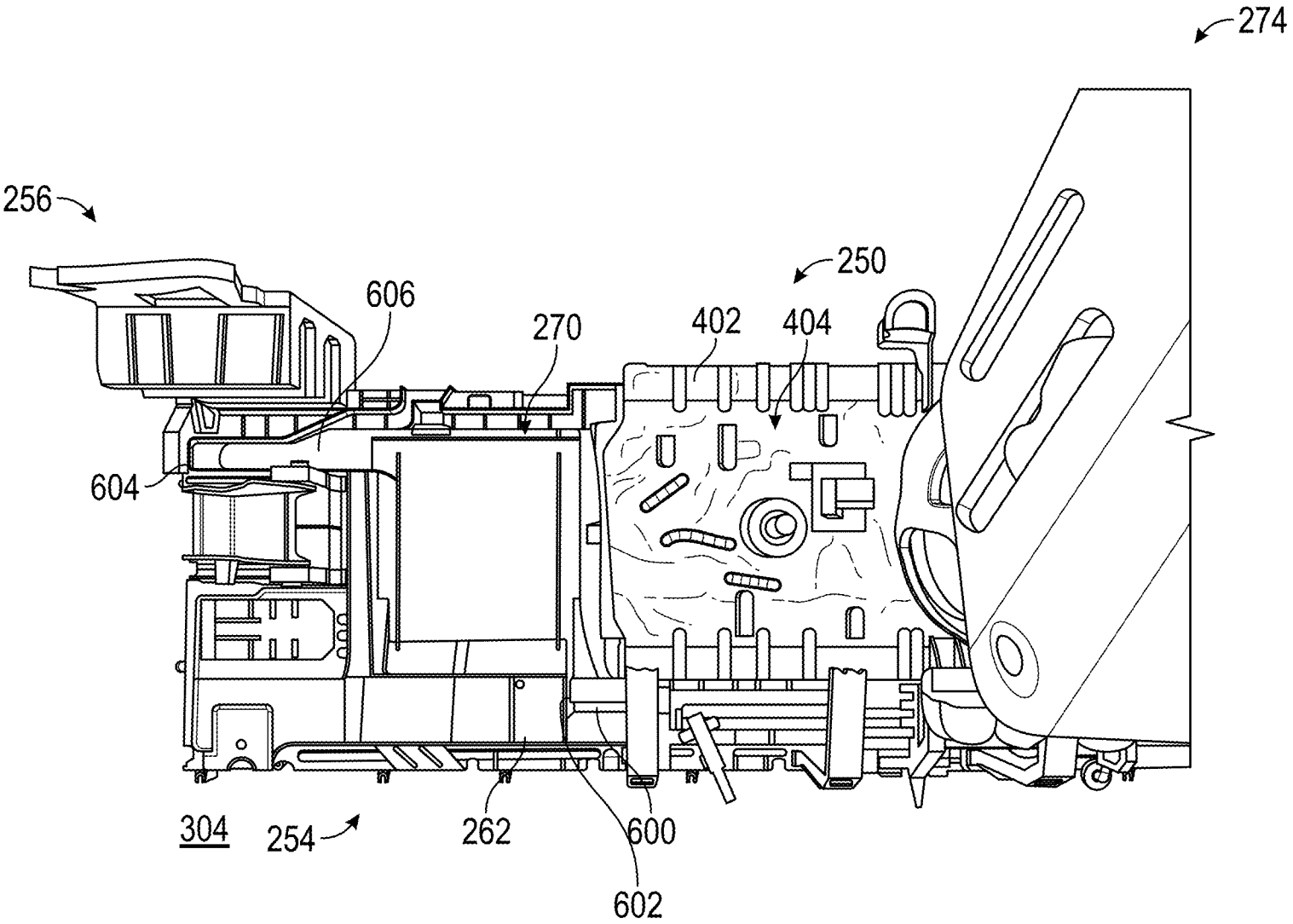
FIG. 5 is a top view of the first portion of the toy playset of FIG. 3A.

As mentioned, when a user plays with playset 250, liquid may spill from the first liquid play feature 266 and/or from the second liquid play feature 268 onto the base 254. For this reason, the base 254 includes channels to direct such liquid in a controlled manner, such as toward a common location. FIG. 5 is a top view of the first portion 256 of the toy playset 250 illustrating channels for directing liquid along the base 254. The first liquid play feature 266 is not shown for visualization purposes. The first portion 256 includes a first channel 600 (e.g., a first track channel) formed into a part of the first base track 262. The first channel 600 is fluidly coupled to the first receptacle 270 to direct liquid to the first receptacle 270. For instance, the first channel 600 may extend along the first base track 262, and a first branch segment 602 may extend from the first channel 600 to the first receptacle 270. Thus, the first receptacle 270 serves as a liquid collection area for the first portion 256 in which liquid may flow from the first channel 600 to the first receptacle 270 via the first branch segment 602. In the depicted embodiment, the first channel 600 is sloped toward the first branch segment 602 to encourage liquid flow from the first channel 600 to the first branch segment 602 via a gravitational force. The first branch segment 602 is oriented transverse to the first channel 600 (e.g., at a perpendicular angle) and sloped from the first channel 600 to the first receptacle 270 to encourage liquid flow from the first channel 600 to the first receptacle 270. Other embodiments may include other features to encourage flow along the first channel 600 to or towards the first receptacle 270 or need not include such features (e.g., with backpressure of liquid accumulation and/or tilting of the toy playset 250 causing flow).

The first portion 256 also includes an outlet 604 configured to direct liquid off the toy playset 250, as well as a second channel 606 (e.g., a discharge channel) fluidly coupling the first receptacle 270 and the outlet 604 to one another. The first receptacle 270 is sloped toward the second channel 606 to encourage liquid flow to the second channel 606 via a gravitational force, and the second channel 606 is sloped from the first receptacle 270 toward the outlet 604 to encourage liquid flow through the second channel 606 and to the outlet 604. Thus, liquid collected in the first receptacle 270, such as liquid received from the first channel 600 is encouraged to flow out of the toy playset 250 via the outlet 604. In other words, the first receptacle 270, the first channel 600, the first branch segment 602, and the second channel 606 collectively direct liquid to the outlet 604. Accordingly, liquid (e.g., liquid carried by the toy vehicle 302 onto the first base track 262) may be directed from different parts of the first portion 256 to the same common location at the outlet 604 to control liquid flow along the first portion 256 and facilitate cleaning of the liquid from the toy playset 250 (e.g., via discharge of the liquid off the toy playset 250 via the outlet 604). However, to reiterate, other embodiments need not include the depicted sloping and can include or not include any desirable features that encourage flow towards the outlet 604 (e.g., with backpressure of liquid accumulation and/or tilting of the toy playset 250 causing flow).

Moreover, in the depicted embodiment, the passage 404 of the support 402 directs liquid from the adjustable component 274 toward the first receptacle 270, such as into the first liquid play feature 266 positioned within the first receptacle 270. The first receptacle 270 may receive some of the liquid directed through the passage 404, such as liquid that does not flow into the first liquid play feature 266. As such, the liquid may also be directed from the adjustable component 274 toward the outlet 604 via the first receptacle 270.

Figure 6:
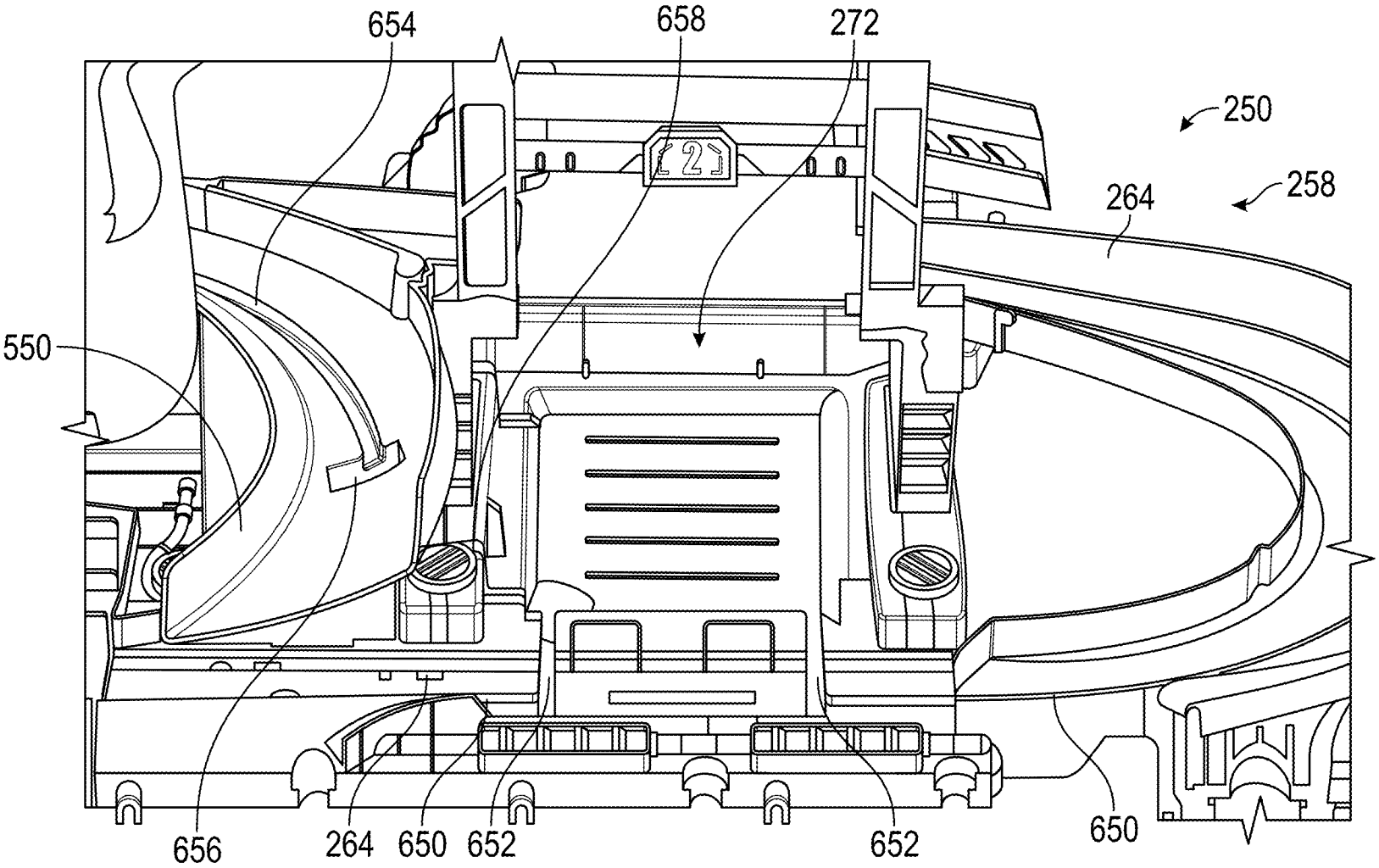
FIG. 6 is a perspective side view of the second portion of the toy playset of FIG. 4A.

FIG. 6 is a perspective side view of the second portion 258 of the toy playset 250. The second liquid play feature 268 is not shown for visualization purposes. The second portion 258 includes a third channel 650 (e.g., a second track channel) formed into a part of the second base track 264. The third channel 650 is fluidly coupled to the second receptacle 272 to direct liquid to the second receptacle 272. For instance, the third channel 650 may extend along the second base track 264, and second branch segments 652 may extend from different parts of the third channel 650 to the second receptacle 272. Thus, the second receptacle 272 serves as a liquid collection area for the second portion 258 in which liquid may flow from the third channel 650 to the second receptacle 272 via the second branch segments 652. As an example, the third channel 650 may be sloped toward the second branch segments 652 to encourage liquid flow from the third channel 650 to the second branch segments 652 via a gravitational force. The second branch segments 652 are oriented transverse to the third channel 650 (e.g., at a perpendicular angle) and may be sloped from the third channel 650 to the second receptacle 272 to encourage liquid flow from the third channel 650 to the second receptacle 272.

A fourth channel 654 is formed into a part of the bypass track 550 and is fluidly coupled to the second receptacle 272 to direct liquid into the second receptacle 272. For example, the fourth channel 654 may extend along the bypass track 550 to an opening 656 formed through the bypass track 550, and a third branch segment 658 is fluidly coupled to the opening 656 and to the second receptacle 272. Thus, liquid may flow along the fourth channel 654, into the opening 656, through the third branch segment 658, and into the second receptacle 272 (e.g., via a gravitational force). As such, the third channel 650, the second branch segments 652, the fourth channel 654, the opening 656, and the third branch segment 658 collectively direct liquid to the second receptacle 272. Accordingly, liquid (e.g., liquid carried by the toy vehicle 302 onto the second base track 264) may be directed from different parts of the second portion 258 to the second receptacle 272.

Figure 7:
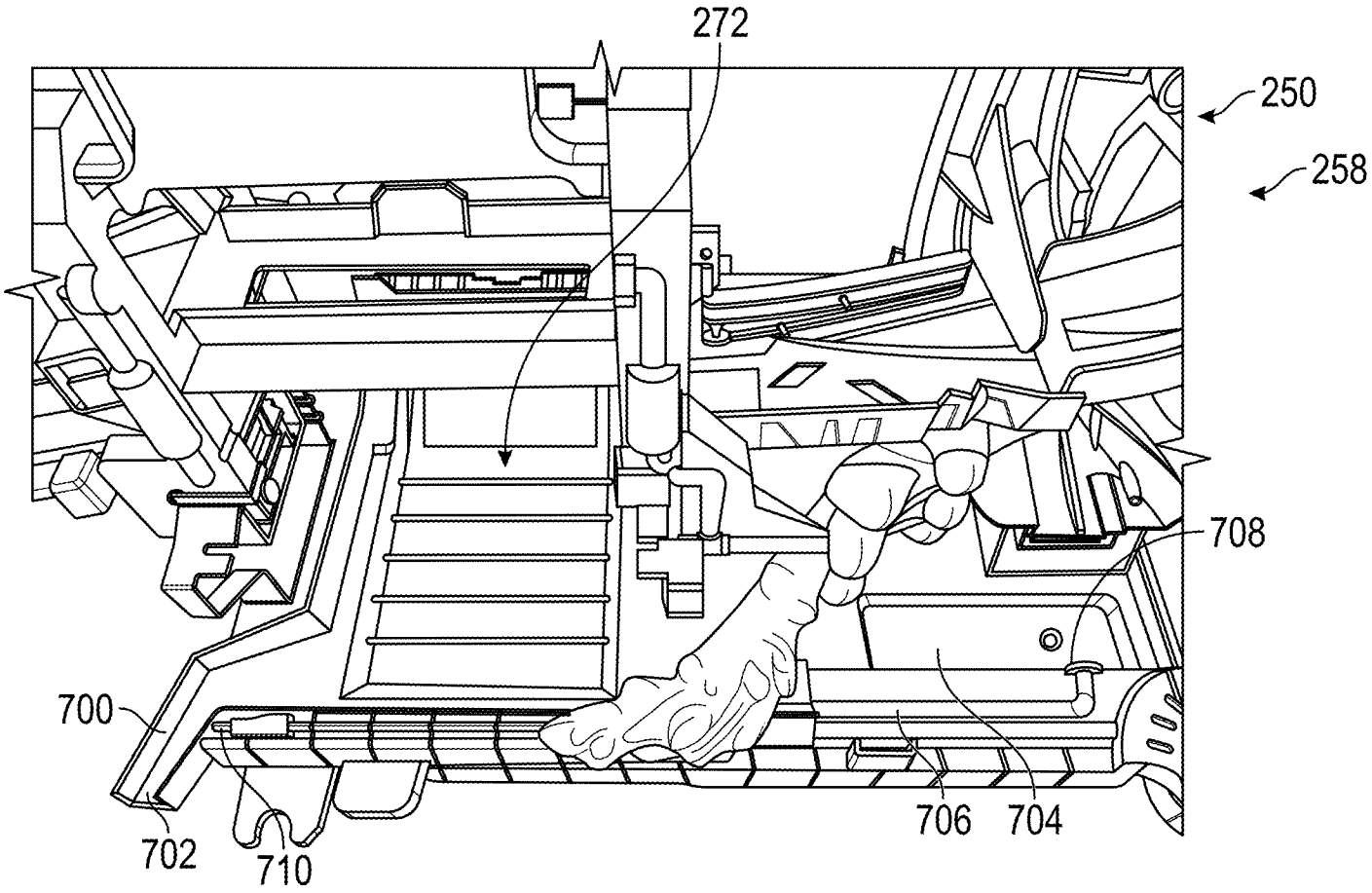
FIG. 7 is a perspective side view of the second portion of the toy playset of FIG. 4A.

FIG. 7 is a perspective side view of the second portion 258 of the toy playset 250. The second liquid play feature 268 is not shown for visualization purposes; instead, FIG. 7 illustrates connection features and further drainage of the toy playset 250. More specifically, the toy playset 250 includes an extension 700, as well as a fifth channel 702 formed through the extension 700. The second receptacle 272 is fluidly coupled to the fifth channel 702, and the second receptacle 272 is sloped toward the fifth channel 702 to encourage liquid flow from the second receptacle 272 to the fifth channel 702 via a gravitational force. Thus, liquid collected in the second receptacle 272, such as liquid received from the third channel 650, from the second branch segments 652, and/or from the second liquid play feature 268 positioned within the second receptacle 272 (e.g., liquid spilled from or overflowing the second liquid play feature 268), is encouraged to flow to the fifth channel 702.

In the first configuration 252 (FIG. 2) of the toy playset 250, the fifth channel 702 is fluidly separated from the outlet 604 of the first portion 256. Thus, in the first configuration 252, the first portion 256 and the second portion 258 may separately direct liquid off the toy playset 250. By way of example, the fifth channel 702 may serve as another outlet in the first configuration 252 to direct liquid off the second portion 258. That is, in the first configuration 252, liquid from the first portion 256 may be directed to a common location off the toy playset 250 via the outlet 604, and liquid from the second portion 258 may be directed to a common location off the toy playset 250 via the fifth channel 702.

The second portion 258 also includes additional channels configured to direct liquid toward the extension 700. As an example, the second portion 258 may include a reservoir 704 configured to receive liquid from another part of the toy playset 250, such as from the adjustable component 274 and/or from the second liquid play feature 268, and to direct liquid toward the extension 700. For instance, the reservoir 704 may be fluidly coupled to the second receptacle 272 (e.g., via another branch segment extending from the reservoir 704 to the second receptacle 272). Additionally or alternatively, the reservoir 704 may be directly fluidly coupled to the fifth channel 702. By way of example, a conduit 706 may extend from the reservoir 704 to the fifth channel 702. The conduit 706 includes an inlet 708 fluidly coupled to the reservoir 704 and an outlet 710 fluidly coupled to the fifth channel 702. Thus, liquid may flow from the reservoir 704, into the inlet 708, through the conduit 706, and to the fifth channel 702 via the outlet 710, thereby bypassing flow through the second receptacle 272.

Figure 8A:
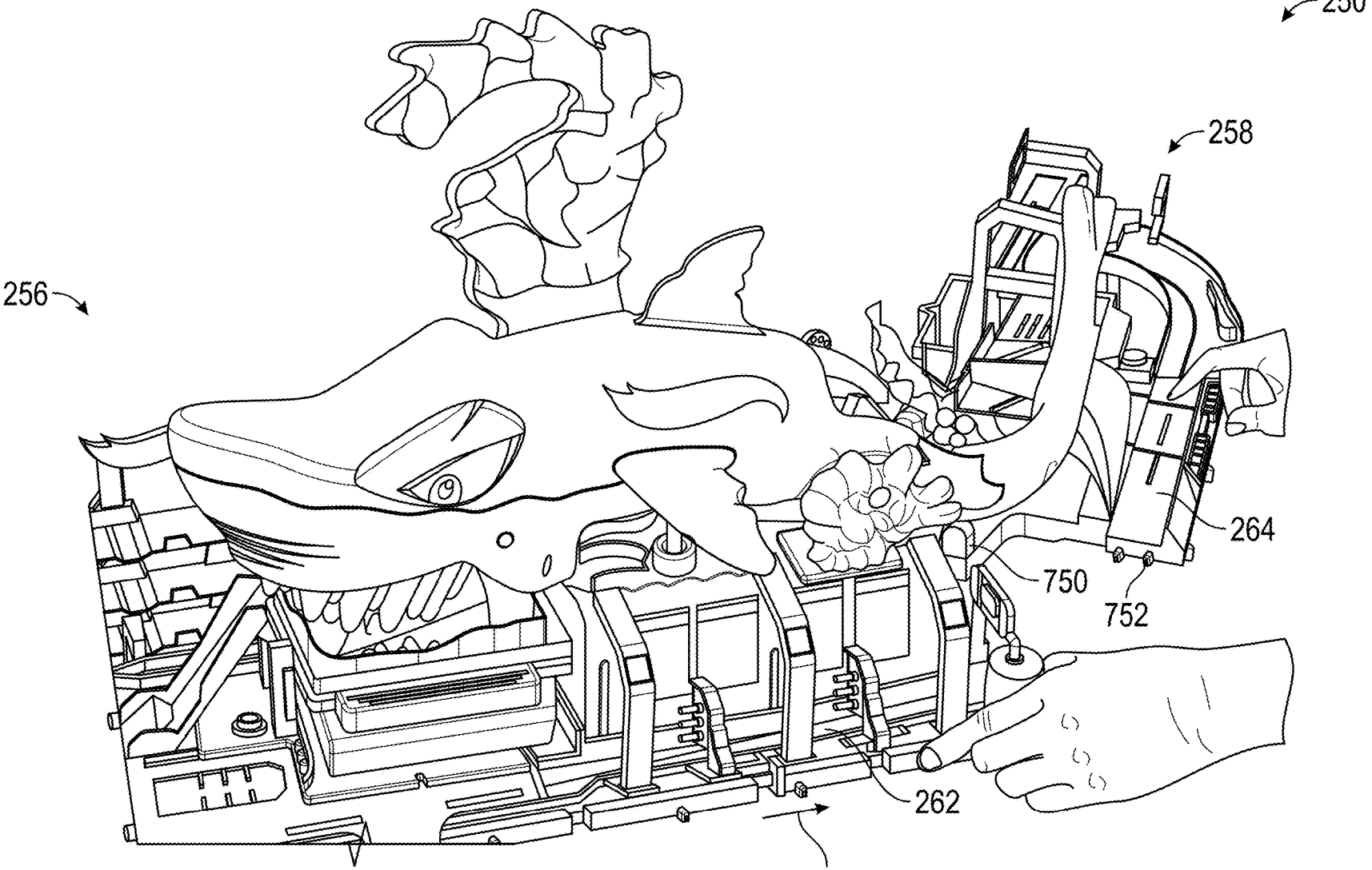
FIG. 8A is a perspective side view of the toy playset of FIG. 2 transitioning to a second configuration.
Figure 8B:
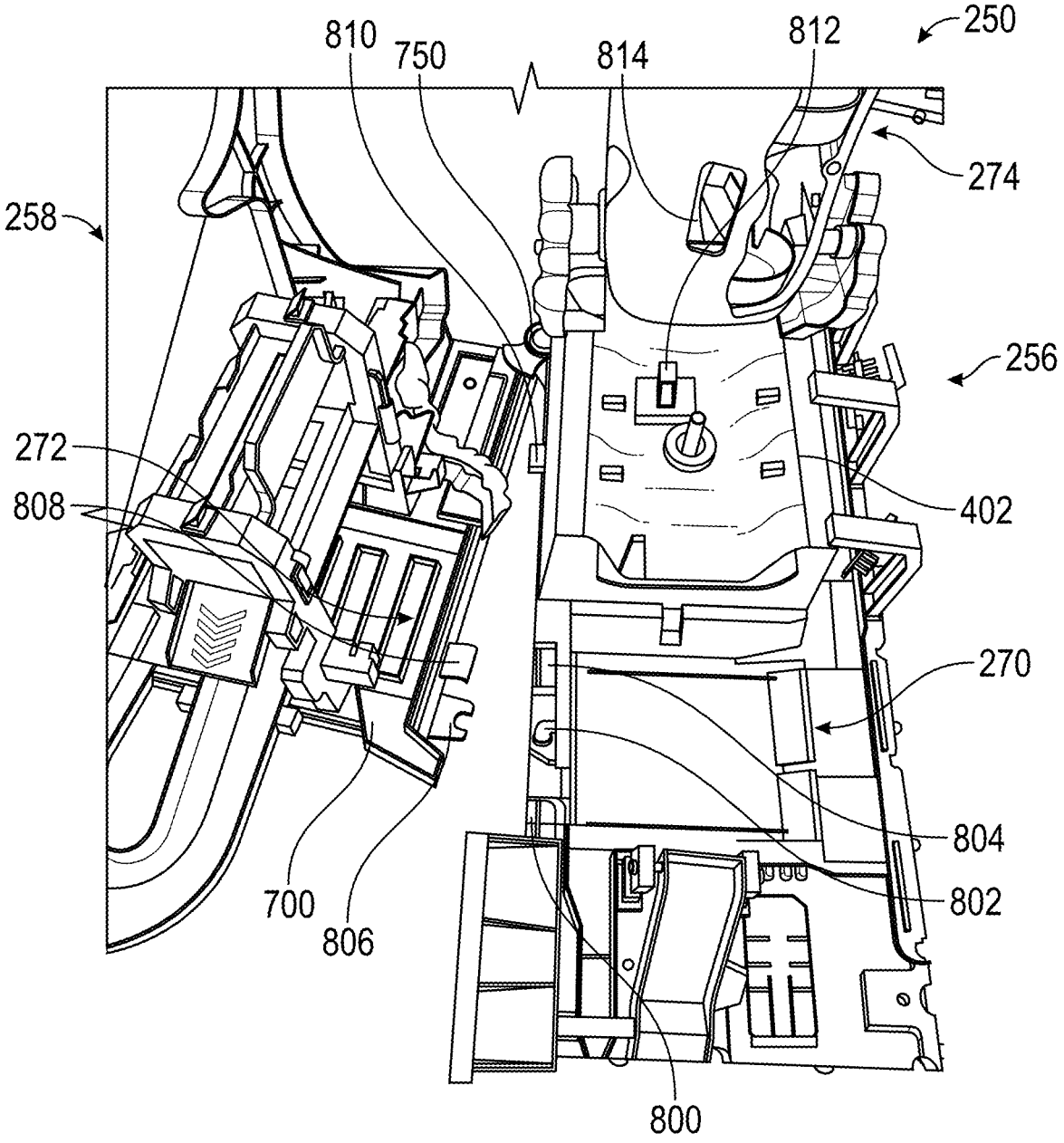
FIG. 8B is a perspective top view of the toy playset of FIG. 2 transitioning to the second configuration.
Figure 8C:
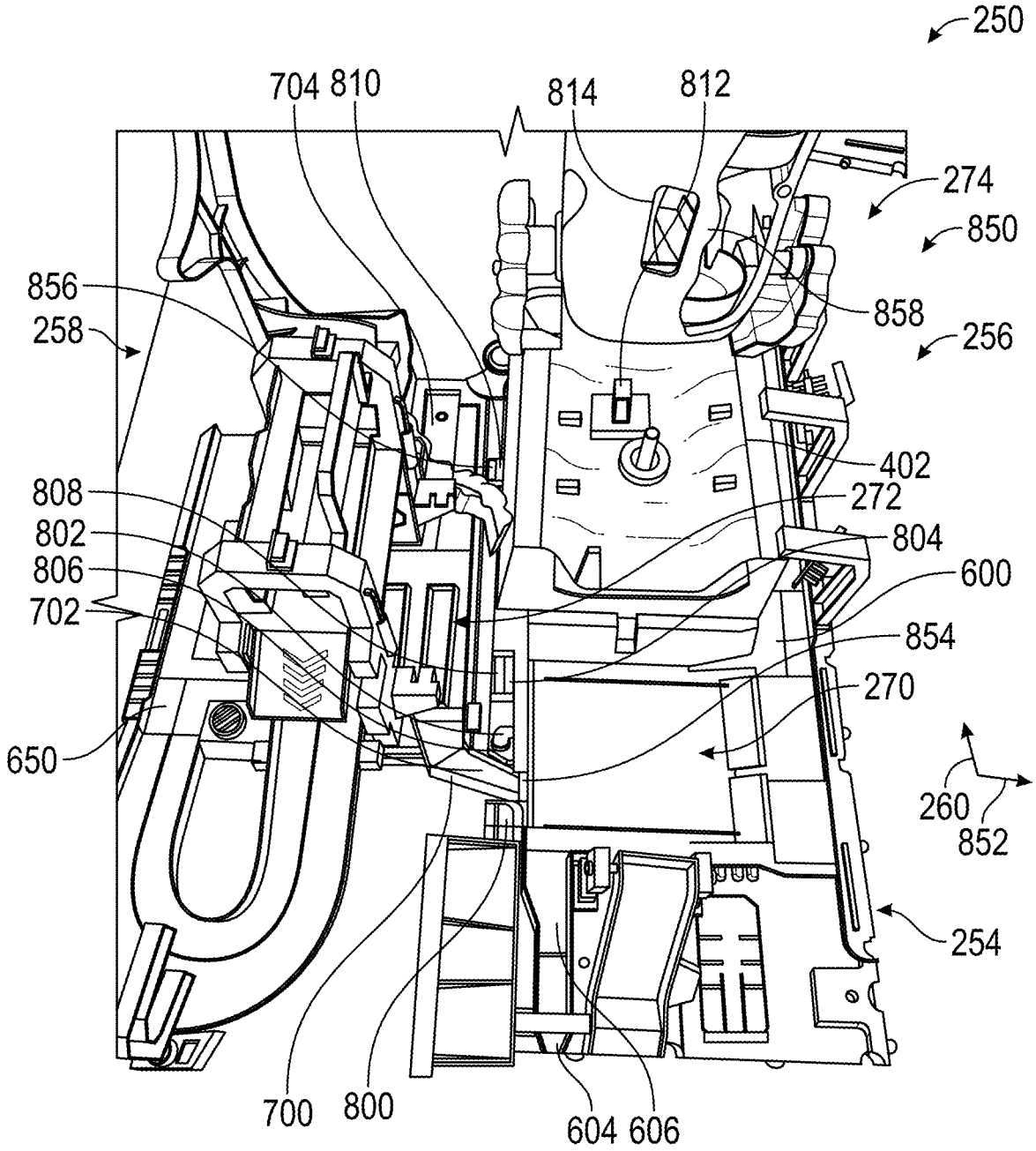
FIG. 8C is a perspective top view of the toy playset of FIG. 2 in the second configuration.

FIG. 8A is a perspective top view of the toy playset 250 illustrating the first portion 256 and the second portion 258 moving relative to one another to transition the toy playset 250 from the first configuration 252 to a second configuration 850 (see FIG. 8C). As an example, the first portion 256 and the second portion 258 are coupled to one another at a hinge or pivot 750 and are configured to rotate relative to one another about the hinge 750. However, in additional or alternative embodiments, the first portion 256 and the second portion 258 may be configured to move relative to one another in another suitable manner, such as linearly along one another. As discussed, the first portion 256 and the second portion 258 are aligned along the first axis 260 in the first configuration 252. Movement of the first portion 256 and second portion 258 relative to one another moves the first portion 256 and the second portion 258 out of alignment along the first axis 260.

The first portion 256 and the second portion 258 may be manually movable relative to one another. For instance, a user may apply a sufficient amount of force to rotate the first portion 256 and the second portion 258 relative to one another about the hinge 750. Relative movement between the first portion 256 and the second portion 258 to transition the toy playset 250 away from the first configuration 252 disengages the first base track 262 of the first portion 256 from the second base track 264 of the second portion 258. For example, the second portion 258 includes inserts 752 extending adjacent to part of the second base track 264. The inserts 752 are configured to extend into corresponding recesses of the first portion 256 (e.g., positioned adjacent to a part of the first base track 262) in the first configuration 252. Movement of the first portion 256 and the second portion 258 relative to one another pulls the inserts 752 out of the recesses to disengage the first base track 262 from the second base track 264.

FIG. 8B is a perspective top view of the toy playset 250 illustrating the first portion 256 and the second portion 258 moving relative to one another to transition the toy playset 250 from the first configuration 252 to the second configuration 850 (see FIG. 8C). In the illustrated embodiment, the first portion 256 and the second portion 258 are oriented such that the first receptacle 270 of the first portion 256 and the second receptacle 272 of the second portion 258 are positioned adjacent to one another. For example, the first portion 256 includes a recess 800, a knob 802, and an interlock 804. The second portion 258 includes the extension 700, a latch 806, and a protrusion 808. Transition of the toy playset 250 toward the second configuration 850 moves the extension 700 toward the recess 800, the latch 806 toward the knob 802, and the protrusion 808 toward the interlock 804.

The first portion 256 also includes a cam 810, which is connected to a hook 812 extending away from the support 402. The cam 810 is movable relative to the support 402, and movement of the cam 810 relative to the support 402 drives corresponding movement of the hook 812 relative to the support 402. Furthermore, the adjustable component 274, which extends away from the support 402 in the illustrated embodiment, includes an opening 814. While the cam 810 is disengaged from the second portion 258 (e.g., while the toy playset 250 is not in the second configuration 850) to extend away from and/or out of the support 402, such as via a force imparted onto the cam 810 by a biasing member, the hook 812 is positioned such that movement (e.g., rotation) of the adjustable component 274 toward the support 402 inserts the hook 812 into the opening 814 without causing the hook 812 to engage with the adjustable component 274. As such, the hook 812 does not hinder movement of the adjustable component 274 relative to the support 402, and the adjustable component 274 may therefore move freely toward and away from the support 402.

FIG. 8C is a perspective top view of the toy playset 250 in the second configuration 850 (e.g., a storage/transport configuration, a compact configuration). In the second configuration 850, the first portion 256 and the second portion 258 extend from one another generally along a second axis 852 (e.g., a lateral axis) and alongside from one another along the first axis 260. In other words, the first portion 256 and the second portion 258 overlap with one another along the first axis 260. Additionally, in the second configuration 850, the extension 700 of the second portion 258 is positioned in the recess 800 of the first portion 256 (e.g., the first portion 256 captures the extension 700 within the recess 800), the latch 806 of the second portion 258 is engaged with the knob 802 of the first portion 256 (e.g., the latch 806 captures the knob 802), and the protrusion 808 of the second portion 258 is positioned in the interlock 804 of the first portion 256 (e.g., the interlock 804 captures the protrusion 808). Such engagement between the first portion 256 and the second portion 258 secures the first portion 256 and the second portion 258 to one another to maintain the toy playset 250 in the second configuration 850.

The first portion 256 and the second portion 258 are also fluidly coupled to one another in the second configuration 850. In particular, positioning the extension 700 in the recess 800 fluidly couples the fifth channel 702 of the second portion 258 to the first receptacle 270 of the first portion 256. Consequently, the second receptacle 272 and the third channel 650 of the second portion 258 will be fluidly coupled to the first receptacle 270 of the first portion 256 (e.g., via fifth channel 702). For this reason, liquid may flow from the second portion 258 (e.g., from the third channel 650, from the second receptacle 272, from the fifth channel 702, from the reservoir 704) into the first receptacle 270, and then from the first receptacle 270, into the second channel 606, and off the toy playset 250 via the outlet 604. Additionally, liquid may flow from the first portion 256 (e.g., from the first channel 600, from the second channel 606, from the first receptacle 270) off the toy playset 250 via the outlet 604. Accordingly, liquid may flow from each of the first portion 256 and the second portion 258 toward a common outlet 604 in the second configuration 850, thereby enabling controlled flow of liquid to a common location (e.g., to facilitate cleaning of liquid from the toy playset 250).

In some embodiments, the first portion 256 includes a barrier 854 positioned in the fifth channel 702. The barrier 854 may further help direct liquid from the second portion 258 toward the outlet 604. By way of example, the barrier 854 may be positioned to block at least a portion of liquid flow from the fifth channel 702 to a part of the first receptacle 270, thereby guiding at least a portion of liquid flow toward the second channel 606 and the outlet 604. As such, the barrier 854 may encourage liquid flow off the toy playset 250 via the outlet 604. However, in some embodiments, the barrier 854 may allow limited flow into the first receptacle 270, e.g., via small openings that meter flow and/or when flow is sufficient to flow over the barrier 854. In other words, barrier 854 may act as a dam, limiting the flow of liquid into the first receptacle 270 except under certain conditions.

Further, in the second configuration 850, the second portion 258 (e.g., a cam surface 856 of the second portion 258) is engaged with the cam 810 of the first portion 256. Engagement of the second portion 258 with the cam 810 moves the cam 810 toward or into the support 402 and causes corresponding movement of the hook 812 relative to the support 402. Consequently, the hook 812 is at a different position in the second configuration 850 than in the first configuration 252 of the toy playset 250. The position of the hook 812 in the second configuration 850 may cause the hook 812 to engage with a segment 858 of the adjustable component 274 (e.g., when the adjustable component 274 extends along the support 402). The engagement of the hook 812 with the segment 858 blocks movement of the adjustable component 274 relative to the support 402. For example, the second configuration 850 may be used to transport (e.g., carry) the toy playset 250, and blocking movement of the adjustable component 274 relative to the support 402 may facilitate transportation of the toy playset 250, such as by using the handle 278 of the adjustable component 274 to lift the adjustable component 274 and the base 254 (e.g., without causing the adjustable component 274 to move relative to the first portion 256).

Figure 9:
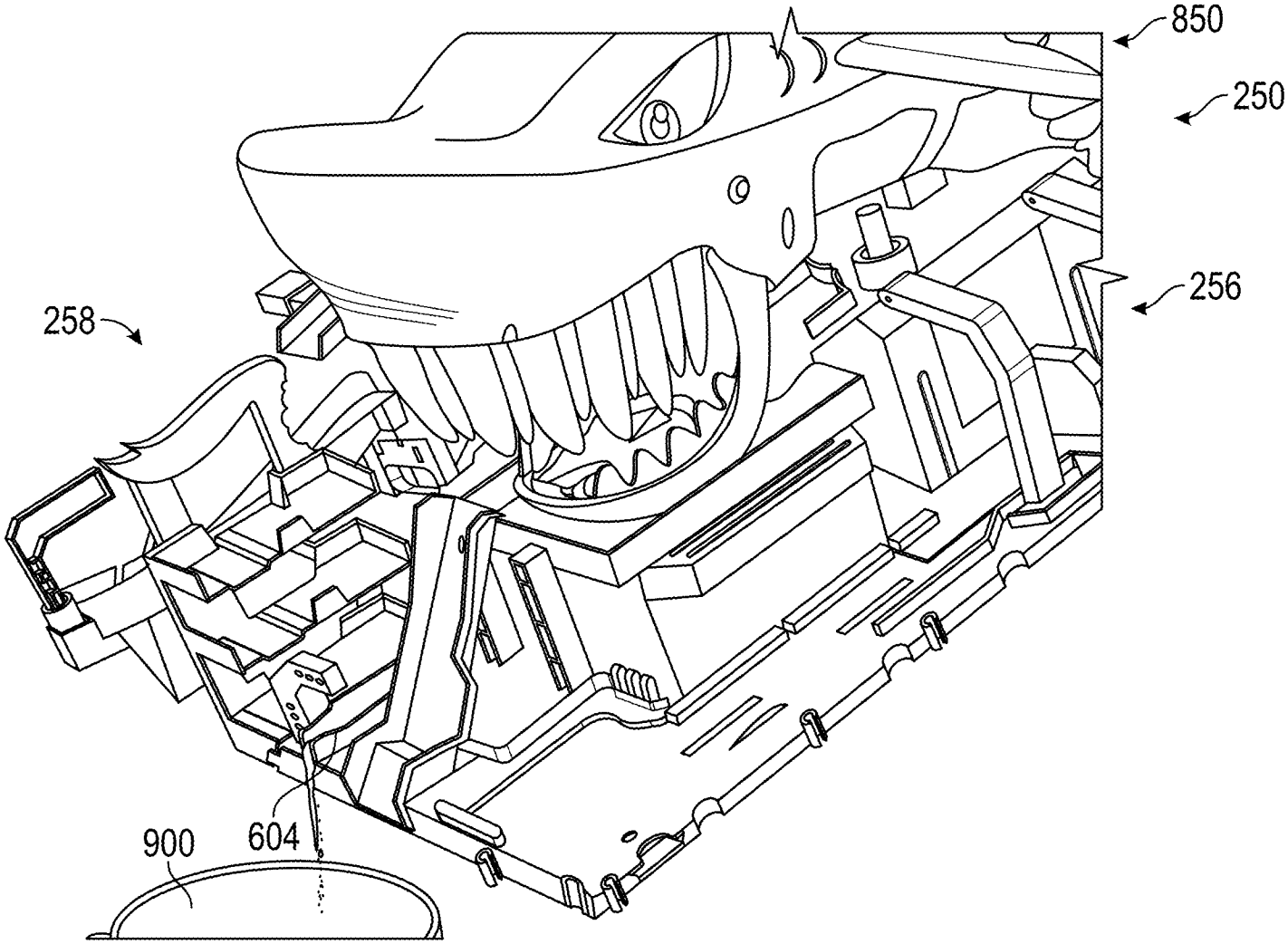
FIG. 9 is a perspective side view of the toy playset of FIG. 2 in the second configuration and outputting liquid.

FIG. 9 is a perspective side view of the toy playset 250 in the second configuration 850. In the illustrated embodiment, the toy playset 250 is oriented to output liquid from the outlet 604 into a vessel 900. For example, the toy playset 250 may be tilted to enable a gravitational force to direct liquid from the first portion 256 and/or from the second portion 258 through the outlet 604 (e.g., via the fifth channel 702 of the second portion 258, via the second channel 606 of the first portion 256) and off the toy playset 250. Thus, liquid is controllably directed to a common location in the vessel 900 via the outlet 604. For this reason, cleaning of the toy playset 250 (e.g., removal of liquid from the toy playset 250) may be more easily performed.

While the toy playsets presented herein have been illustrated and described in detail and with reference to specific embodiments thereof, it is nevertheless not intended to be limited to the details shown, since it will be apparent that various modifications and structural changes may be made therein without departing from the scope of the disclosure and within the scope and range of equivalents of the claims. In addition, various features from one of the embodiments may be incorporated into another of the embodiments. That is, it is believed that the disclosure set forth above encompasses multiple distinct embodiments with independent utility. While each of these embodiments has been disclosed in a preferred form, the specific embodiments thereof as disclosed and illustrated herein are not to be considered in a limiting sense as numerous variations are possible. The subject matter of the disclosure includes all novel and non-obvious combinations and subcombinations of the various elements, features, functions and/or properties disclosed herein. Accordingly, it is appropriate that the appended claims be construed broadly and in a manner consistent with the scope of the disclosure as set forth in the following claims.

It is also to be understood that the toy playsets described herein, or portions thereof may be fabricated from any suitable material or combination of materials, such as plastic, foamed plastic, wood, cardboard, pressed paper, metal, supple natural or synthetic materials including, but not limited to, cotton, elastomers, polyester, plastic, rubber, derivatives thereof, and combinations thereof. Suitable plastics may include high-density polyethylene (HDPE), low-density polyethylene (LDPE), polystyrene, acrylonitrile butadiene styrene (ABS), polycarbonate, polyethylene terephthalate (PET), polypropylene, ethylene-vinyl acetate (EVA), or the like. Suitable foamed plastics may include expanded or extruded polystyrene, expanded or extruded polypropylene, EVA foam, derivatives thereof, and combinations thereof.

Additionally, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present disclosure to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the disclosure.

Moreover, when used herein, the term "comprises" and its derivations (such as "comprising", etc.) should not be understood in an excluding sense, that is, these terms should not be interpreted as excluding the possibility that what is described and defined may include further elements, steps, etc. Similarly, where any description recites "a" or "a first" element or the equivalent thereof, such disclosure should be understood to include incorporation of one or more such elements, neither requiring nor excluding two or more such elements. Meanwhile, when used herein, the term "approximately" and terms of its family (such as "approximate", etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially". For example, the term "approximately" can denote a tolerance of plus or minus 0.002 inches, 0.001 inches, or up to 0.005 inches. The same applies to the terms "about" and "around" and "substantially." Moreover, for the purposes of the present disclosure, the phrase "A and/or B" means (A), (B), or (A and B), and the phrase "A, B, and/or C" means (A), (B), (C), (A and B), (A and C), (B and C), or (A, B and C).

Finally, the techniques presented and claimed herein are referenced and applied to material objects and concrete examples of a practical nature that demonstrably improve the present technical field and, as such, are not abstract, intangible, or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

What is claimed is:

1. A toy playset, comprising:

a first base portion having a first channel and an outlet, wherein the first channel is configured to receive a liquid and direct the liquid toward the outlet, and the outlet is configured to direct the liquid off the toy playset;

a second base portion having a second channel, wherein the first base portion and the second base portion are configured to move relative to one another to transition the toy playset between a first configuration and a second configuration, and the first channel and the second channel are fluidly coupled to one another in the second configuration such that the second channel is configured to direct the liquid toward the outlet via the first channel; and a receptacle configured to receive a liquid container, wherein in the second configuration of the toy playset, the receptacle is positioned between the first channel and the outlet, between the second channel and the outlet, or both, and the receptacle is configured to disengage from the liquid container in both the first configuration and the second configuration.

2. The toy playset of claim 1, comprising a track configured to receive and direct movement of a toy vehicle, wherein the first channel and/or the second channel are formed into the track.

3. The toy playset of claim 1, wherein the receptacle is configured to direct the liquid from the first channel, the second channel, or both toward the outlet.

4. The toy playset of claim 1, wherein the second base portion extends from the first base portion along an axis in the first configuration, and the second base portion extends alongside the first base portion along the axis in the second configuration.

5. The toy playset of claim 4, wherein the first base portion comprises a recess, the second base portion comprises an extension and a third channel formed in the extension, the second channel and the third channel are fluidly coupled to one another, and the extension is configured to engage with the recess in the second configuration to fluidly couple the second channel and the third channel to the outlet of the first base portion.

6. The toy playset of claim 5, wherein the receptacle is configured to fluidly couple to the third channel of the second base portion in the second configuration of the toy playset to fluidly couple the second channel and the third channel to the outlet.

7. The toy playset of claim 6, wherein the second base portion comprises a second receptacle configured to receive a second liquid container, and the second receptacle fluidly couples the second channel and the third channel to one another.

8. The toy playset of claim 1, comprising a first track and a second track that are each configured to receive and direct movement of a toy vehicle, wherein the first track is located on the first base portion, the second track is located on the second base portion, the first channel is formed into the first track, and the second channel is formed into the second track.

9. The toy playset of claim 8, wherein the first track and the second track are engaged with one another in the first configuration, and the first track and the second track are disengaged from one another in the second configuration.

10. A toy playset, comprising:

a track configured to receive and direct movement of a toy vehicle;

a channel formed through the track;

a receptacle configured to receive a liquid container and collect liquid spilled from the liquid container;

a branch segment extending transversely from the channel to the receptacle to direct liquid from the track to the receptacle; and an outlet configured to receive liquid from the receptacle and direct liquid off the toy playset.

11. The toy playset of claim 10, comprising an additional channel configured to receive liquid from the receptacle and direct liquid to the outlet.

12. A toy playset, comprising:

a first base portion, comprising:

a first track configured to receive and direct movement of a toy vehicle; and an outlet configured to direct liquid off the toy playset; and a second base portion configured to rotate relative to the first base portion to transition the toy playset between a first configuration and a second configuration, wherein the second base portion comprises:

a second track configured to receive and direct movement of the toy vehicle, wherein the first track is engaged with the second track in the first configuration of the toy playset, and the first track is disengaged from the second track in the second configuration of the toy playset; and a channel configured to direct liquid from the second track to the outlet in the second configuration of the toy playset, wherein the channel is fluidly separate from the outlet in the first configuration of the toy playset.

13. The toy playset of claim 12, wherein the first base portion comprises a recess, the second base portion comprises an extension, the channel is formed in the extension, and the extension is configured to engage with the recess in the second configuration of the toy playset.

14. The toy playset of claim 12, wherein the second base portion extends away from the first base portion in the first configuration, and the second base portion extends alongside the first base portion in the second configuration.

15. The toy playset of claim 12, comprising an adjustable component coupled to the first base portion, wherein the adjustable component is configured to move relative to the first base portion, and the adjustable component comprises a third track configured to receive and direct movement of the toy vehicle.

16. The toy playset of claim 15, wherein the first base portion comprises a cam connected to a hook, and the second base portion is configured to engage with the cam in the second configuration to move the hook into engagement with the adjustable component to block movement of the adjustable component relative to the first base portion.

17. The toy playset of claim 12, wherein the first base portion comprises a receptacle configured to receive a liquid container, and the receptacle is configured to collect liquid spilled from the liquid container and direct liquid toward the outlet.

18. The toy playset of claim 12, wherein the second base portion comprises a receptacle configured to receive a liquid container, and the receptacle is configured to collect liquid spilled from the liquid container, liquid from the second track, or both and direct liquid to the channel.

* * * * *